US007866113B2

(12) United States Patent
Young

(10) Patent No.: US 7,866,113 B2
(45) Date of Patent: Jan. 11, 2011

(54) SYSTEM AND METHOD FOR ADJUSTABLE REPAIR AND REINFORCEMENT OF NON-STANDARD DOORS AND JAMBS

(75) Inventor: Glenn I. Young, Richmond, VA (US)

(73) Assignee: Armor Concepts, LLC, Nashville, TN (US)

( * ) Notice: Subject to any disclaimer, the term of this patent is extended or adjusted under 35 U.S.C. 154(b) by 143 days.

(21) Appl. No.: 12/272,936

(22) Filed: Nov. 18, 2008

(65) Prior Publication Data

US 2010/0122502 A1 May 20, 2010

(51) Int. Cl.
*E04C 2/38* (2006.01)

(52) U.S. Cl. ..... 52/656.4; 52/126.3; 52/204.1; 52/213; 52/656.2; 292/346; 49/460

(58) Field of Classification Search ..... 52/204.1, 52/213, 215, 126.1, 126.3, 126.2, 656.4, 52/656.2; 292/340, 342, 346; 49/460, 462
See application file for complete search history.

(56) References Cited

U.S. PATENT DOCUMENTS

| | | | | | |
|---|---|---|---|---|---|
| 1,483,333 | A | | 2/1924 | Capece | |
| 2,489,072 | A | * | 11/1949 | Ausubel | 16/402 |
| 2,837,787 | A | * | 6/1958 | Wright | 52/717.01 |
| 3,934,910 | A | * | 1/1976 | Radke | 292/346 |
| 4,126,343 | A | | 11/1978 | Ragland | |
| 4,139,999 | A | | 2/1979 | Allenbaugh | |
| 4,171,836 | A | | 10/1979 | St. Aubin | |
| 4,295,299 | A | | 10/1981 | Nelson | |
| 4,547,009 | A | | 10/1985 | Allen | |
| 4,635,399 | A | | 1/1987 | Gehrke et al. | |
| 4,717,185 | A | | 1/1988 | Hartley | |
| 4,763,499 | A | | 8/1988 | Boyle | |
| 4,770,452 | A | | 9/1988 | Petree, Jr. | |
| 4,809,400 | A | | 3/1989 | Allen | |
| 4,854,621 | A | | 8/1989 | Baldwin | |
| 4,858,384 | A | * | 8/1989 | Blankenship | 49/460 |
| 4,861,082 | A | * | 8/1989 | Priola et al. | 292/346 |
| 4,993,764 | A | | 2/1991 | Barker | |
| 5,031,946 | A | * | 7/1991 | Yarrow | 292/337 |
| 5,070,650 | A | * | 12/1991 | Anderson | 49/460 |
| 5,076,626 | A | | 12/1991 | Tiddy et al. | |

(Continued)

OTHER PUBLICATIONS

USPTO Office Action; U.S. Appl. No. 11/382,301; mailing date Aug. 23, 2007.

(Continued)

*Primary Examiner*—Brian E Glessner
*Assistant Examiner*—Joshua Ihezie
(74) *Attorney, Agent, or Firm*—Waddey & Patterson; Mark J. Patterson

(57) ABSTRACT

A door security system serves to substantially improve the reliability of the entire door assemblies with non-standard door jamb thicknesses. The system may comprise up to four or more components. An adjustable door jamb shield may be mounted around a door jamb on the side of the door jamb corresponding to the door slab free swinging edge. Another adjustable door jamb shield may also be mounted on a door jamb on the hinge side of the door jamb. The adjustable shields comprise attachable sleeves that wrap on three sides around the door jamb to reinforce and stabilize the door system.

30 Claims, 16 Drawing Sheets

U.S. PATENT DOCUMENTS

| | | | | | |
|---|---|---|---|---|---|
| 5,203,130 | A | * | 4/1993 | Freelove | 52/211 |
| 5,241,790 | A | | 9/1993 | Schimpf | |
| D348,202 | S | | 6/1994 | Booth | |
| 5,566,509 | A | | 10/1996 | Long | |
| 5,566,995 | A | | 10/1996 | Jagiela | |
| 5,570,917 | A | | 11/1996 | Cutrer | |
| 5,586,796 | A | * | 12/1996 | Fraser | 292/346 |
| 5,640,808 | A | | 6/1997 | Simeone et al. | |
| 5,737,878 | A | | 4/1998 | Raulerson et al. | |
| 5,752,728 | A | | 5/1998 | Matouschek | |
| 5,836,628 | A | * | 11/1998 | Beier | 292/346 |
| 6,082,049 | A | * | 7/2000 | Hudson | 49/460 |
| 6,418,669 | B1 | * | 7/2002 | Suter | 49/462 |
| 6,526,708 | B1 | * | 3/2003 | Hartley et al. | 52/211 |
| 6,598,350 | B1 | * | 7/2003 | Suter | 49/506 |
| 6,679,019 | B2 | * | 1/2004 | Rochman | 52/455 |
| 6,679,533 | B1 | * | 1/2004 | Bruner et al. | 292/346 |
| 6,684,572 | B2 | * | 2/2004 | Homolka et al. | 49/462 |
| 6,691,466 | B2 | * | 2/2004 | Childress | 49/462 |
| 6,826,877 | B1 | * | 12/2004 | Stradel | 52/211 |
| 6,857,672 | B1 | * | 2/2005 | Drew, II | 292/341.18 |
| 7,134,246 | B1 | * | 11/2006 | Olberding et al. | 52/210 |
| 7,467,818 | B2 | * | 12/2008 | Young | 292/341.14 |
| 7,543,864 | B2 | * | 6/2009 | Barthel | 292/340 |
| 2003/0159361 | A1 | * | 8/2003 | Yeremian | 49/504 |
| 2003/0189341 | A1 | * | 10/2003 | Perry | 292/346 |
| 2007/0273164 | A1 | * | 11/2007 | Young | 292/340 |
| 2008/0224486 | A1 | * | 9/2008 | Anderson | 292/340 |
| 2009/0077909 | A1 | * | 3/2009 | Barthel | 52/204.1 |
| 2010/0115862 | A1 | * | 5/2010 | Young | 52/204.1 |

OTHER PUBLICATIONS

USPTO Office Action; U.S. Appl. No. 11/382,301; mailing date Jan. 2, 2008.

USPTO Office Action; U.S. Appl. No. 11/382,301; mailing date Apr. 9, 2008.

* cited by examiner

5A

5B

8A

8B

SYSTEM AND METHOD FOR ADJUSTABLE REPAIR AND REINFORCEMENT OF NON-STANDARD DOORS AND JAMBS

FIELD OF THE INVENTION

The present invention relates to an adjustable door security system, specifically to a mounting system for reinforcement, repair and improved security of non-standard door assemblies including but not limited to those with sidelights, wooden enclosures and non-standard jamb member thicknesses.

BACKGROUND OF THE INVENTION

There is an ever increasing need and demand for improving the security and structural integrity of entry doors. This demand is being driven by the repeated occurrences of unauthorized and forced entry through entry doors.

Typically such improvements have focused on pick resistant locks, longer and stronger dead bolts, and guard plates. Generally the strengthening and protecting of the locks and bolts have proven to be ill fated attempts at increasing the security of entry doors. The fact is these locks and bolts are mounted and anchor into very soft wooden door slabs and jambs, making their overall effectiveness minimal for security purposes when utilized without overall reinforcement. Traditionally the lock bolt is located in the door slab close to and passing through the doors edge. With this arrangement any significant force applied to the door assembly will cause it to yield and thereby allowing the dead bolt to rip through the door slab. As well the bolt extends into the door jamb through a strike plate that is held in place by short screws. These screws only extend a short distance into the door jamb to secure the strike plate around the receiving opening that is located very close to the inner edge of the jamb. The resulting orientation of the lock bolt, strike plate, and receiving opening is that a thin section of the wooden door jamb is all that remains to resist inward motion of the door slab when the lock bolt is engaged. With this arrangement a person may cause the bolt to rip through the retaining section of the door assembly or jamb merely by applying sufficient force to the door slab itself. Consequently forced entry may be gained without any disturbance or defeat of the security offered by the locking device. Furthermore, due to the construction of doors with sidelights, the jamb stanchions are only secured to the upper jamb and sill plate with minimal hardware that is easily defeated as well.

Historically one point of forced entry has been the door jamb specifically in the region where the free swinging edge of the door slab interfaces with the strike plate area of the door jamb. On doors assemblies with deadbolt locks and wooden door slabs or steel door slabs with wooden cores, the wooden jambs particularly in the area where the bolt of the locking mechanism is common to both, the door jamb is considerable inadequate. Consequently prior devices are designed for strengthening and reinforcing this area. These devices did further the structural support of the door assembly, yet overall these devices have considerable shortcomings. To begin with these devices did nothing to strengthen the overall door assembly, so any applied force was merely transferred to another point of weakness. As well these devices were frequently aesthetically unacceptable and designed for only type of application. Their design features also made installation difficult for a traditional layperson. In some cases the visibility of the device made it more easily defeated. It should also be noted that in many instances such reinforcement devices are sought after the occurrence of forced entry and damage to the doorjamb. The presence of this damage on the existing door assembly will prohibit use of the current devices and prohibit proper application of the strike plate. Furthermore none of the prior art was designed to be adjustable to accommodate jambs of varying width and height with a singular device.

Yet other prior art consists of a door shield or cover plate that wraps around the door from the interior side through the lock area to the exterior. These U-shaped door shields position on the free swinging edge of the door slab with the side panels overlying and extending along opposite sides of the door slab and are typically secured in position by the locking mechanism. Door shielding devices will offer some degree of protection to the door slab, however due to their construction are limited in security they offer. These devices are either outdated, made of material that is more decorative than strength oriented, or are only designed for one lock. As well they offer minimal security when singularly applied.

Still other devices were developed to support and strengthen the door jamb in the area of corresponding to the mounting of the hinges on vertical hung doors. Again these devices are difficult to install in the afforded space of existing doors or require significant detailed finish carpentry to properly complete application. As previously stated these devices are also not designed to be adjustable.

Though these prior art devices were realized with the best intent, the need still exists for a door security device that focuses on the overall structural inadequacy of doors mounted in wooden assemblies and their repair. The current art fails to produce a system that equally and complementary addresses the conventional points of forced entry and structural vulnerability of vertically hung door assemblies for new and existing structures. Though much of the available prior art will afford greater strength, stability and support of vertically hung hinged doors, they nevertheless suffer from a number of disadvantages:

1. The design of the current art does not permit repair of non-standard broken doorjambs while the door and jamb are still hung in place. Thus the door must be replaced or removed to allow the jamb to be repaired prior to deploying these devices.

2. In many instances the current devices cannot be used on non-standard jambs that are damaged.

3. The current devices often have visible parts that are often unsightly. This takes away from the overall aesthetics of the door.

4. The current devices that are installed on the backside of the jamb are difficult to hold in place and align while being attached. These devices will further prove their inadequacy on non-standard assemblies.

5. Due to the material thickness of these jamb reinforcement devices or the method of installation several of them require considerable finish carpentry skill to install. These requirements would make installation difficult for a layperson and prove to be impossible on non-standard jamb assemblies.

6. Many of the components are ineffective due to their singular nature and individual deployment. Using components separately limits the security they can offer.

7. Construction and materials make current devices unsightly. Their finish can also limit there application due to inability to be painted easily or at all.

8. The devices in current use are made from relatively soft material or materials that limit their application as practical security products by design.

9. Many hinge and jamb reinforcement and protectors in current use do not wrap around the jamb. Thus their overall effectiveness for securing and reinforcing the doorjamb is limited by design.

10. The current devices do not offer adjustability for door components outside the realm of modern day industry standard.

BRIEF SUMMARY OF THE INVENTION

It is an object of the present invention to overcome the foregoing drawbacks and shortcomings of the current state of art with door security assemblies that focus on the overall structural inadequacy of doors mounted in and supported by wooden door jambs. The components of the present system can be used alone or in combination to equally and complimentarily address the conventional points of forced entry and structural vulnerability of vertically hung hinged doors with non-standard assemblies, for new and existing structures by utilizing adjustable wrapping technology. Component parts of the system are generally obscured from view by design. The present invention affords greater strength, stability, and adjustable support to vertically hung hinged door assemblies that have not been heretofore achieved, in such a manner. As well the object of the present invention is to provide a structurally sound means of repair for previously damaged said door assemblies. After installation, the component parts alone or in combination cooperate to substantially benefit and enhance the structural integrity of entry door assembly.

As previously disclosed the present invention is for vertically hung hinged entry door assemblies and particularly suited for doors with wooden door jambs. The door assemblies comprise a four sided wooden door jamb with three hinges on one side to hingedly fix the door slab to the door assembly. The assembly components shall also include a door sealing surface that will be situated in the offset surface of the doorjamb and rests against the exterior face of the door slab when in the closed position. Typically there will be a latch bolt lock situated below a dead bolt lock, installed in typical fashion. The door jamb adjacent to the free swinging edge of the door will have openings positioned so as to allow the plunger portion of the dead bolt to engage a strike plate and be received into the door jamb upon closure and lock activation.

The door security system presented here will serve to substantially improve the strength and reliability of the entire door assembly. This system will typically comprise up to four to six main components all suitably manufactured of rugged material, preferably steel, and all necessary securing hardware. Securing hardware will depend upon the door application and will be sized to pass through the doorjamb immediately surrounding the door and penetrate a sufficient depth into the rough frame of the main structure. This system can be incorporated into the manufacturing process of door assemblies, applied cooperatively to new assemblies, or installed on previously hung doors assemblies as functions of the overall system benefit. The latter application can be done by the average layperson with basic hand tools and minimal carpentry experience. Thus significant features of the present invention include allowing for application of the system on previously installed door assemblies and the repairing of damaged assemblies while originally placed, in simple and uncomplicated fashion. The lack of complexity is achieved by the thin three-sided wrapping construction of the components, which allows them to easily slide onto position in the applicable areas.

Installation is accomplished by removing the interior doorjamb decorative trim molding and cutting or removing the fasteners that fix the door jamb to the underlying rough frame. Additionally, at least two screws are removed from each hinge to be modified. The system components are installed in their corresponding locations and the frame is verified to still be square. The finished frame is secured to the rough frame with the proper hardware while at the same time securing all system components. Once installed, the jamb portions of the system are totally concealed on a closed door that has been properly hung and finished in normal fashion (i.e., not visible from the opposite side of the door).

With this system, as previously stated, the components can work together to ensure greater strength, stability and support of vertically hung hinged doors. The components that can be combined to make up this system and their function will follow.

1. The door jamb shielding component corresponding to the door slab free swinging edge and coinciding doorjamb comprise two elongated, substantially equal length members, each having basically "L" shaped cross sections and constructed of about 16-24 gauge steel sheet metal. The two members fit together to form a slide-on sleeve. The sleeve serves to wrap around the door jamb from the facing (i.e., medial) surface of the door jamb adjacent the free swinging edge of the door slab, around to the interior edge of the door jamb (the sleeve is adjustable to accommodate door jambs of varying thicknesses), and finally extending along the backside (i.e., lateral surface) of the door jamb from the interior to the exterior edge. The sleeve mounts with the common adjustable center section of the sleeve positioned to flushly contact and engage the interior edge of the door jamb; while the side panels extend in parallel, flushly contacting the door jamb on both sides, towards the exterior edge. In the region of the free-swinging edge of the door slab and bolt receiving holes of the door jamb, there will be holes in the sleeve to accommodate upper and lower lock bolts. Typically this door assembly arrangement comprises a dead bolt lock oriented above a latch bolt lock. The suitably sized dead bolt lock when manipulated will pass through a first side panel of the sleeve and proceed through the original wooden door jamb. The length of the jamb shield and its the wrapping feature serve to spread any force applied to the doorjamb while transferring such load to the door assembly surrounding structure, thereby preventing the splitting of the door jamb. After installation of the doorjamb component, on a typical door assembly, only a relatively small portion of the jamb member is left exposed above and below the device. Notably this limits the force applied to the doorjamb in the unprotected areas and ensures that this force will be a shear-type force. These shear forces are applied to the entire cross section of the doorjamb in this region instead of the minimal strike plate area of the doorjamb in an unprotected door assembly. This wrapping feature of the sleeve is a major factor in the uniqueness of this component and the present system of invention. The technology allows the doorjamb to be wrapped and, once secured with screws, the rigidity of the jamb is significantly increased. Furthermore the jamb-shielding component allows for universal application by accommodating various lock spacing between the previously mentioned traditional locking mechanisms. The doorjamb shield has considerations for new manufactured door assemblies and may be incorporated into the doorjamb prior to application of the door assembly weather seal at the factory.

2. The hinge side jamb shield comprises two elongated, substantially unequal length members, each having basically "L" shaped cross sections and constructed of about 16-24 gauge steel sheet metal. The two members fit together to form a slide-on sleeve. The sleeve serves to wrap around the doorjamb from the facing (i.e., medial) surface of the doorjamb adjacent the fixed edge the door slab, around to the interior edge of the doorjamb (the sleeve is adjustable to accommodate door jambs of varying thicknesses), and finally extending along the backside (i.e., lateral surface) of the doorjamb from the interior to the exterior edge. The sleeve mounts with the common adjustable center section of the sleeve positioned to flushly contact and engage the interior edge of the doorjamb; while the side panels extending in parallel, flushly contacting the door jamb on both sides, towards the exterior edge. The leading edge of the facing surface portion will come to rest underneath the weather-sealing component of the doorjamb. This adjustable wrapping of the sleeve is a major factor in the uniqueness of this component as well. The present component allows the doorjamb to be wrapped in steel along three sides in the area of the hinge assembly and, once secured with suitable screws, the rigidity of the hinge assembly mounting area of the doorjamb is greatly benefited with improved ability to resist force applied against the jamb. The portion of the component contacting the inside area of the jamb and fitting behind the weather stripping (this portion may be termed the medial panel) will be substantially shorter that the back section of the component (i.e., the portion of the component contacting the lateral surface of the jamb—this portion may be termed the lateral panel) to allow for positioning between the hinge assembly mounting areas. The medial panel of the component is positioned so as to be generally centered between two of the hinges (e.g., the middle hinge and the bottom hinge) on the inside panel, while the lateral panel extends above and below these two hinges. Units installed on new manufactured doors will be incorporated into the frame prior to installation of the door seal at the factory. The primary function of the hinge side jamb shield is to prevent forced entry that occurs by defeating the conventional hinges and mounting hardware of vertically hung hinged steel doors with wooden frames; while at the same time talking advantage of the adjustable nature of said component to maximize the number of different door assemblies to which the device can be applied. Secondly, this component will stabilize the door in the event of attempted forced entry on the lock side of the entryway.

3. The door-shielding component is an elongated section of about 16-24 gauge steel sheet metal that has a generally U-shaped cross section. The door-shielding component serves to wrap around the free-swinging edge of the door slab in the region corresponding to the lock bolts exiting the door. The door-shielding component mounts with the bottom of the "U" flushly contacting the free swinging edge of the door slab and the elongated side panels extending in parallel, flushly contacting the door on both sides, along the interior and exterior faces of the door slab, towards the hinge side of the door. There is an opening in the bottom of the "U" positioned to allow the lock bolt mechanisms to operate without interference. The bolts of the upper and lower locks, when manipulated accordingly, will pass through the door shield component and into the facing surface of the jamb shield component before continuing as detailed in the jamb component description. Another hole with coinciding orientation to the hole in the bottom of the "U" will pass through door shield component perpendicular to the aforementioned holes. These holes will serve as the lock mounting space. The primary function of the door shield component as applied to the present invention is to prevent force on the lock bolts from splitting the free-swinging edge of the door slab. The door-shielding component subsequently serves to prevent tampering with the locking mechanism. Finally this component can be effective in preventing foreign objects from being forced between the door slab free swing edge and the door jamb interface by creating a much closer tolerance in this region. There are at least two versions of this component. A standard version allows for typical lock spacing between the dead bolt and latch bolt. Furthermore a universal application accommodates various lock spacing between the previously mentioned traditional locking mechanisms. The door-shielding component may have considerations for new manufactured door assemblies and may be incorporated into the frame prior to installation of the door assembly weather seal at the factory.

4. The mounting hardware for each alternative component of the present invention will consist of appropriately sized screws. These screws should be sized to allow a minimum one-inch penetration into the rough wood frame of an entryway. When mounting into masonry structures, comparable screws will be required. The mounting hardware component of the present invention be will suitable for this application and ensure that the door jamb portion of the door assembly is substantially secured to the rough frame of the surrounding structure, further assuring proper deployment of the system. As well the mounting hardware of the featured invention will need to be of a sort suited to inhibiting weather related deteriorating and corrosion.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

FIGS. 3, 3A, 3B and 3C are front elevation, perspective, and side views of the medial half of a door jamb shield for use on the free swinging door side of an entry door assembly.

FIGS. 4, 4A, 4B and 4C are front elevation, perspective, and side views of the lateral half a door jamb shield for use on the free swinging door side of an entry door assembly.

FIGS. 5, 5A and 5B are perspective views of a portion of a door jamb and door jamb shield corresponding to the free swinging door edge of an entry door assembly.

FIGS. 6, 6A, 6B and 6C are front elevation, perspective and side views of the medial half of a door jamb shield for use on the hinged door side of an entry door assembly.

FIGS. 7, 7A, 7B and 7C are front elevation, perspective, and side views of the lateral half a door jamb shield for use on the hinged door side of an entry door assembly.

FIGS. 8, 8A and 8B are perspective views of the portion of a door jamb and a door jamb shield corresponding to the hinged door edge of an entry door assembly.

FIGS. 9, 9A-C are front elevation, perspective and side views of alternative examples of a door slab reinforcement plate.

Figure 10A:
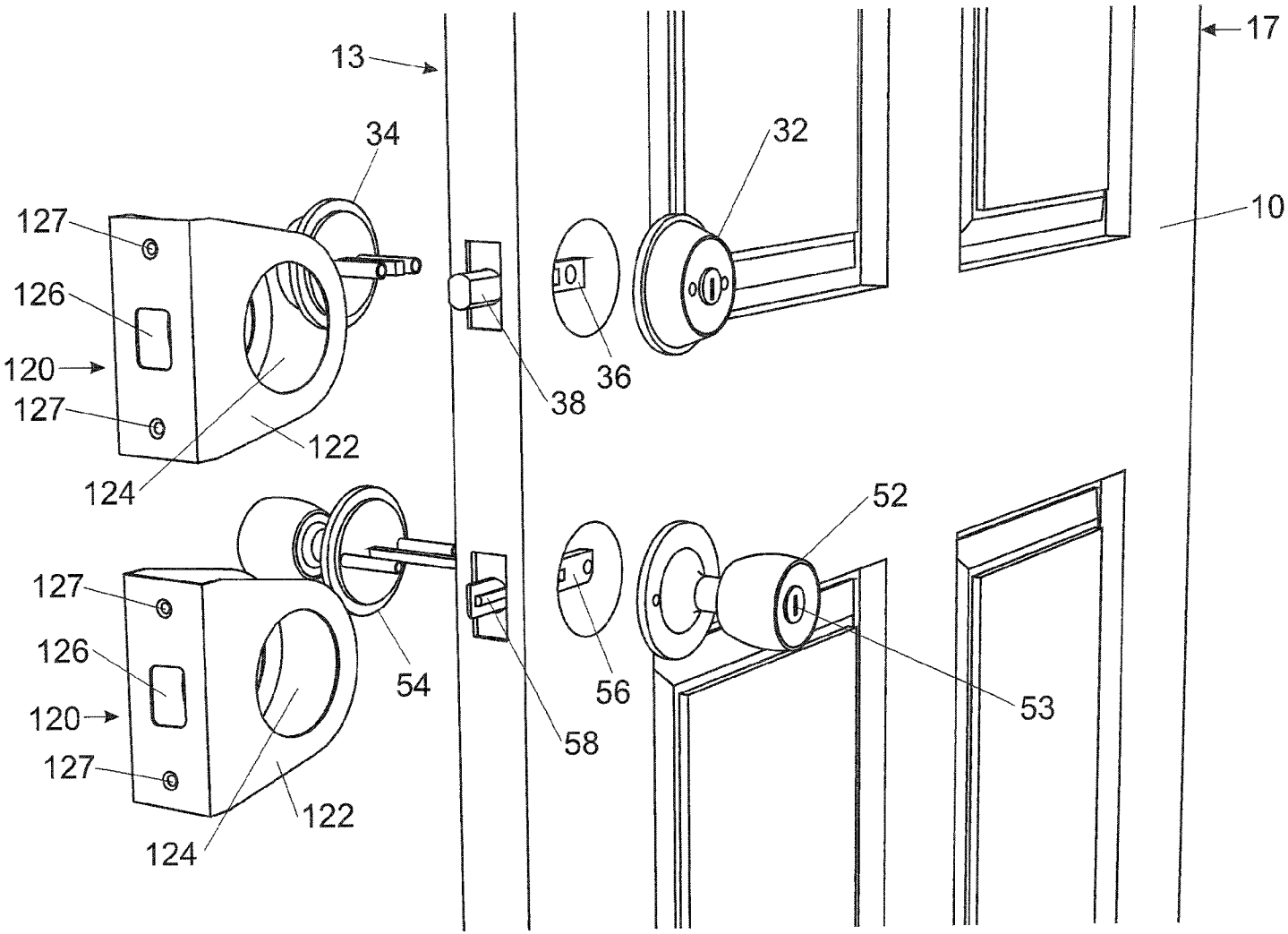
Figure 10B:
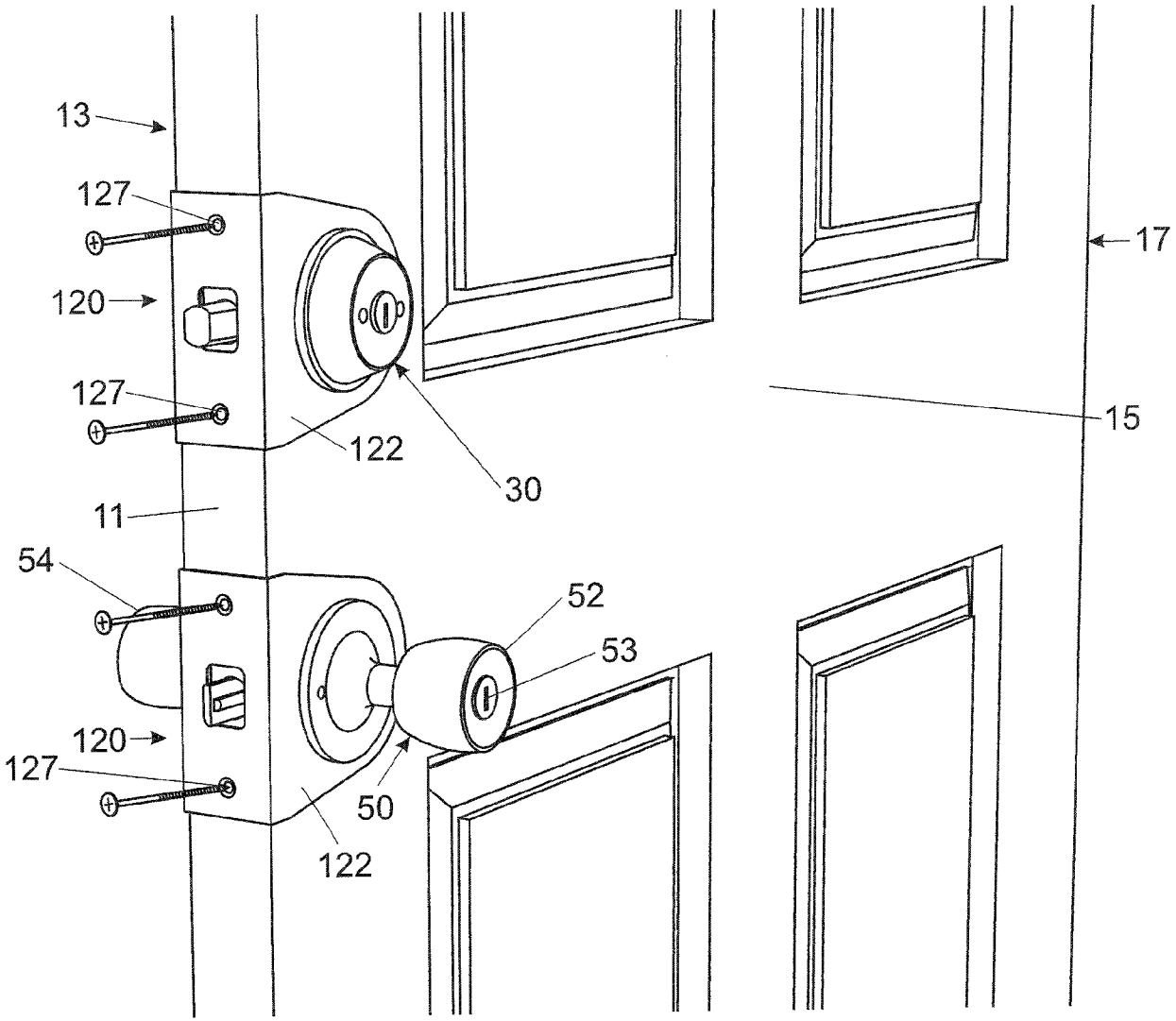

FIGS. 10A and 10B are perspective views of a door slab and door slab shield.

Figure 1:
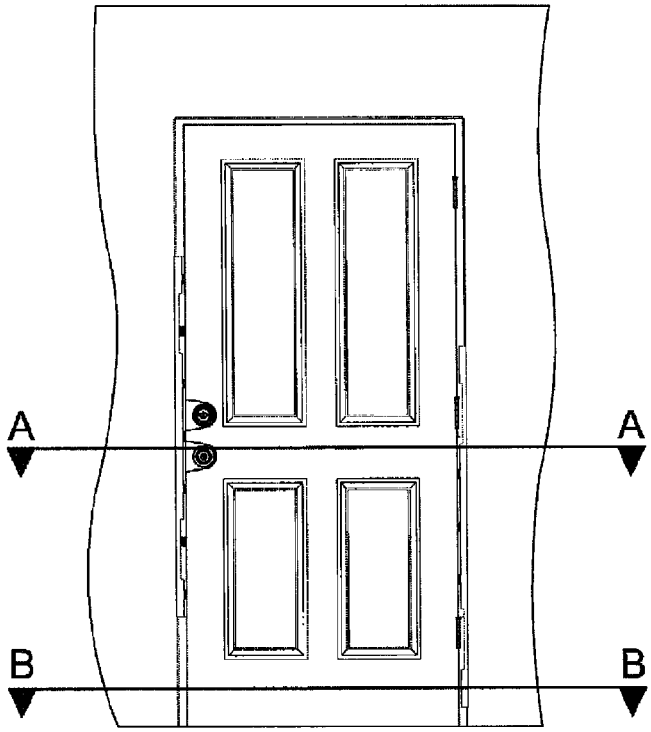
FIG. 1 is a front elevation view of an entry door assembly incorporating shield components described herein.
Figure 1A:
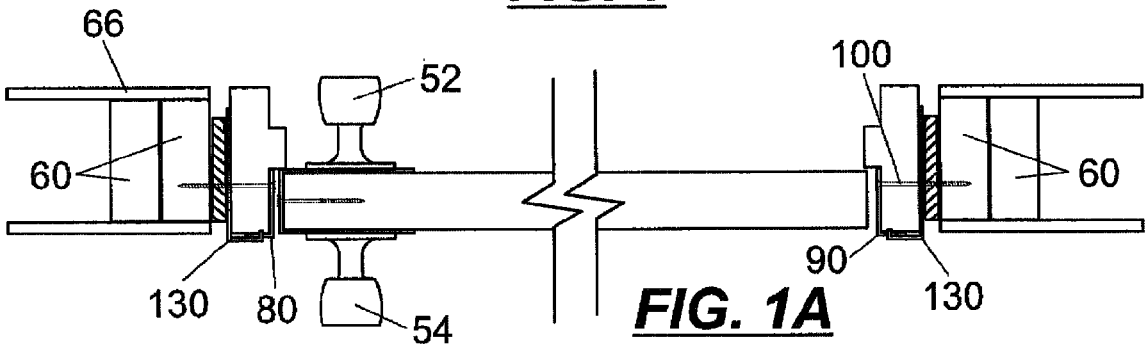
FIGS. 1A and 1B are top, cross-sectional views of the door shown in FIG. 1 taken along lines A-A and B-B respectively.
Figure 1B:
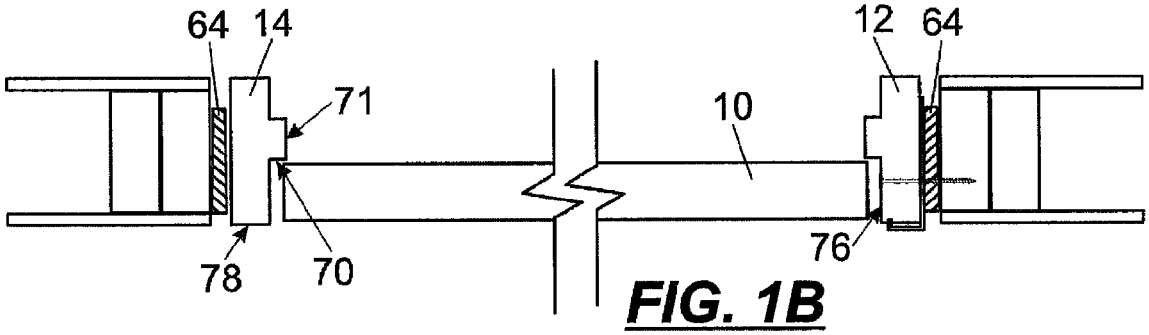
Figure 2:
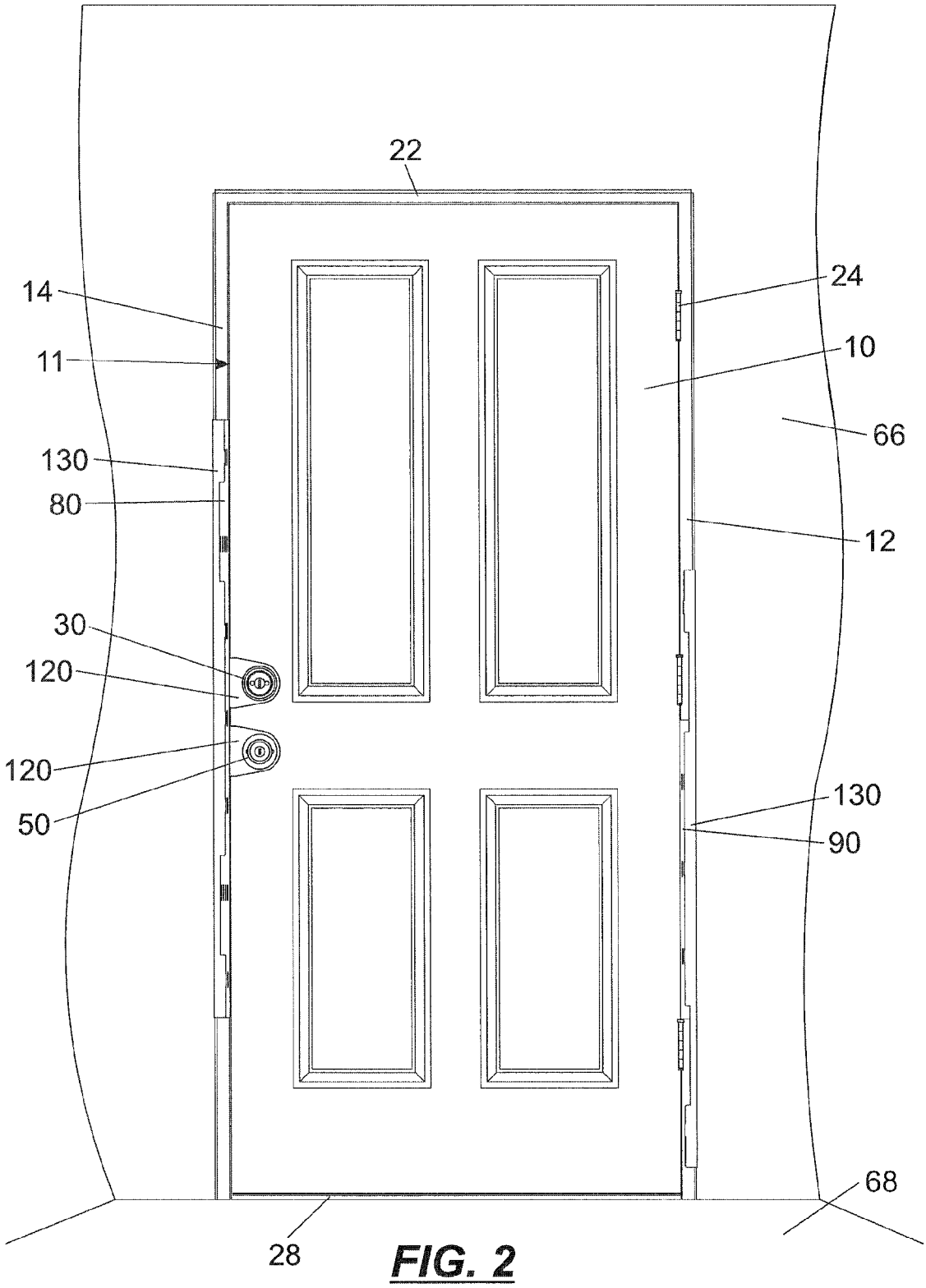
FIG. 2 is a front elevation view of an entry door assembly without any trim molding mounted around the doorway.
Figure 3:
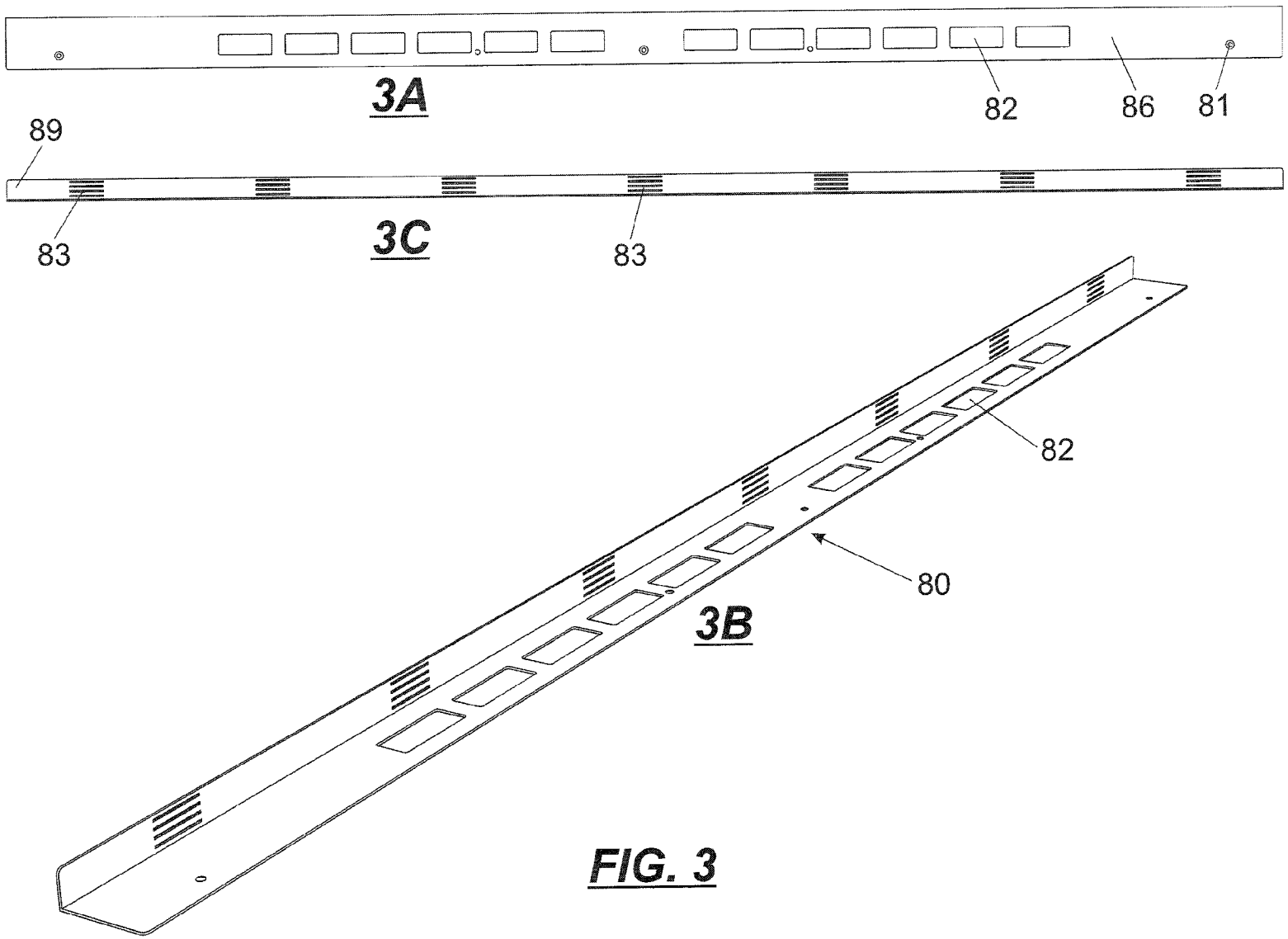
Figure 4:
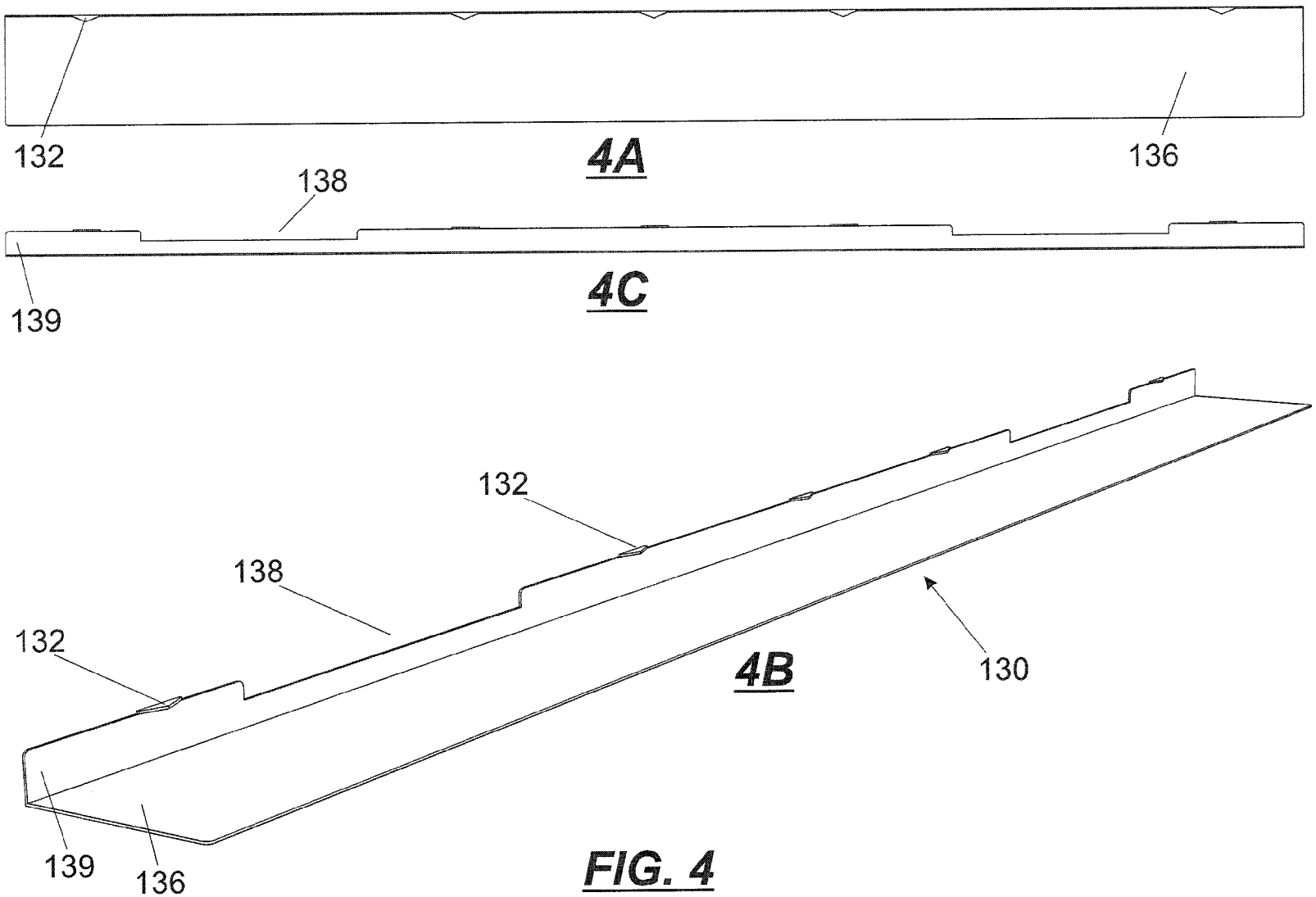
Figure 11:
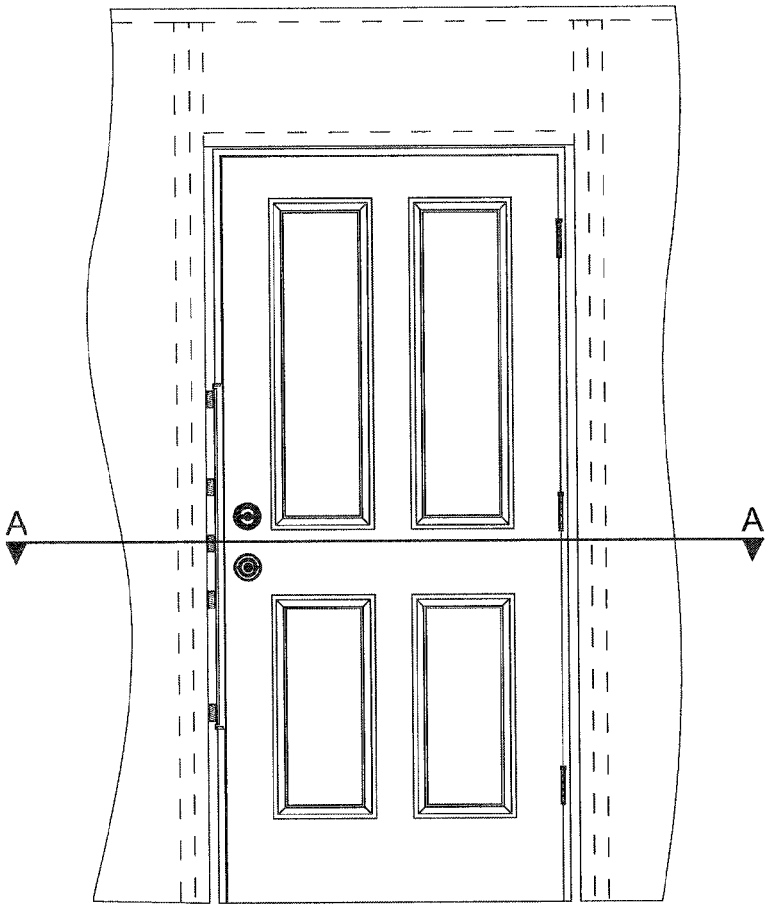
Figure 11:
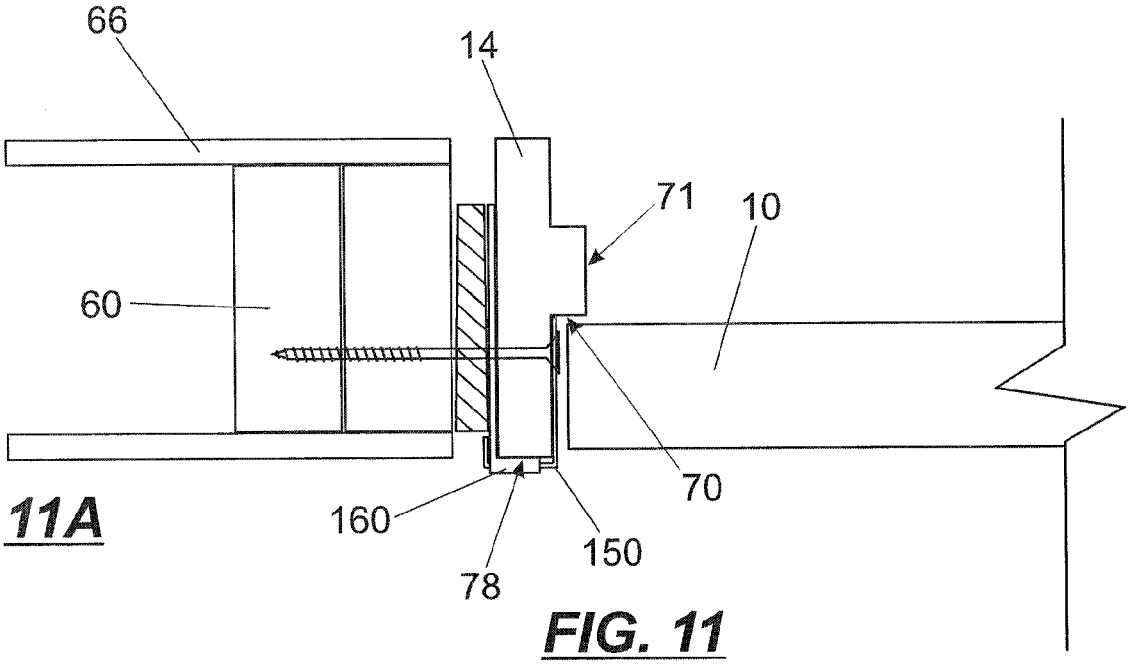

FIG. 11 is a front elevation view of an entry door assembly incorporating alternative shield components described herein. FIG. 11A is a top, cross-sectional view of the door shown in FIG. 1 taken along lines A-A.

Figure 12:
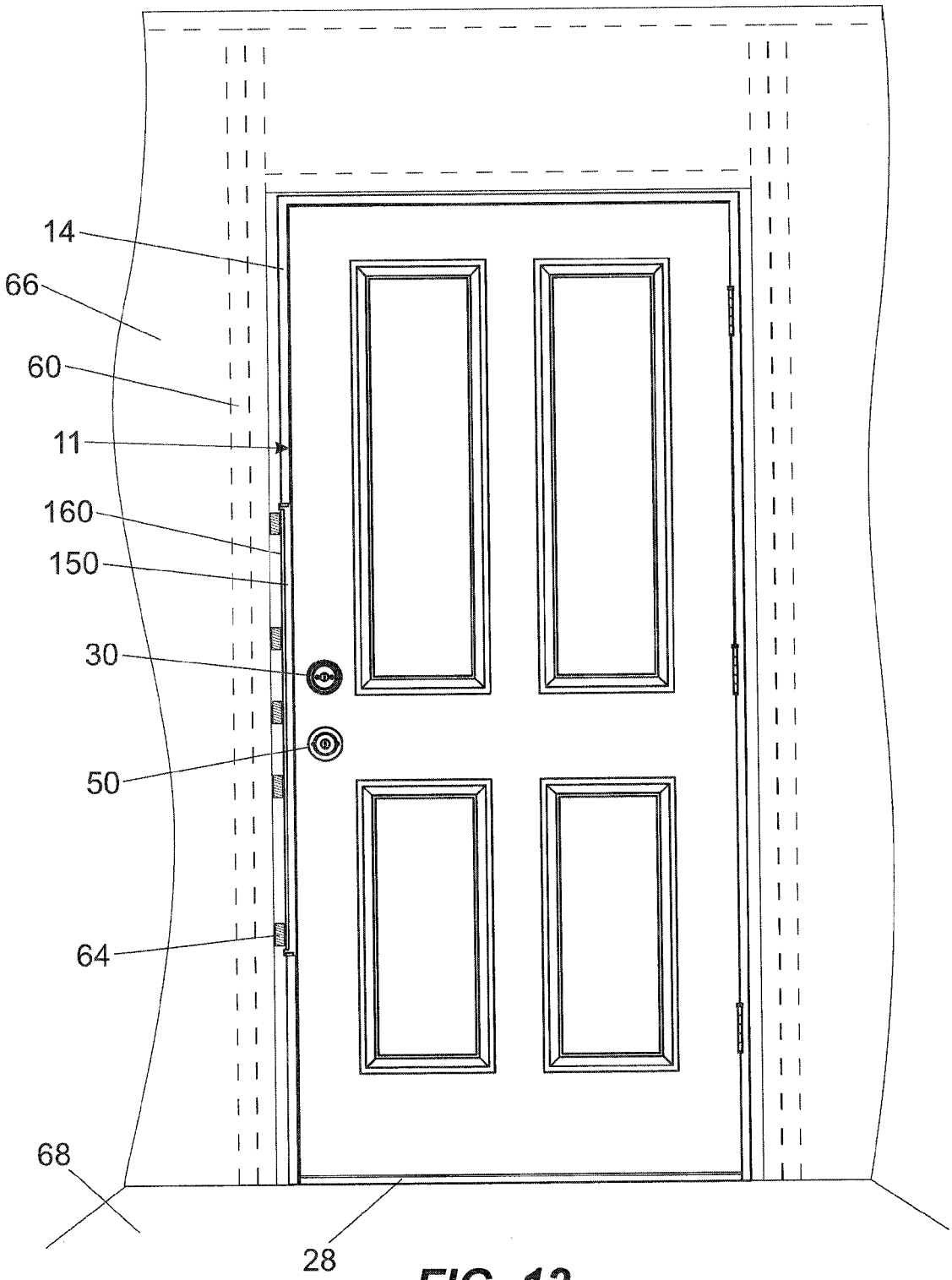
Figure 13:
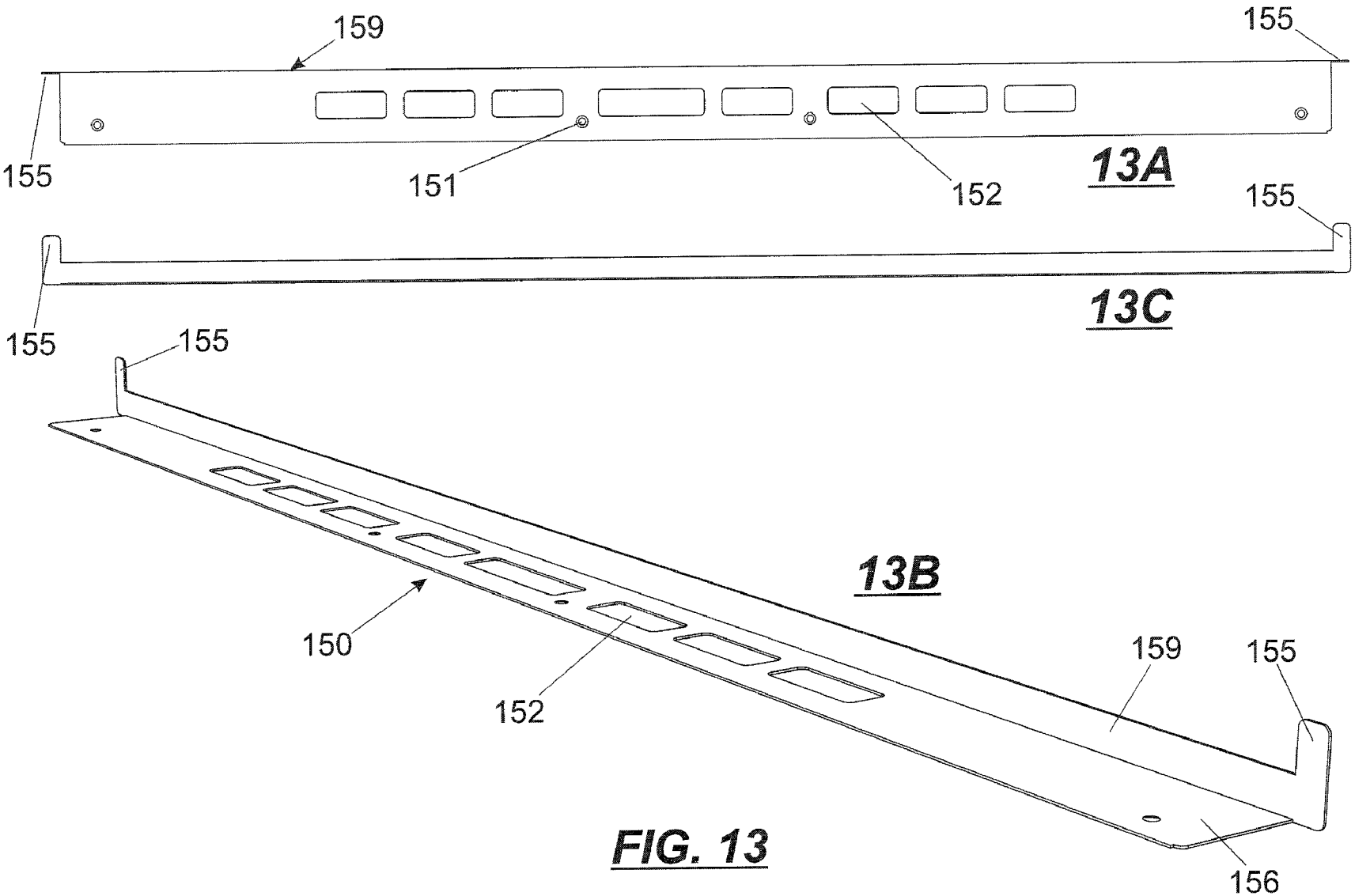
Figure 14:
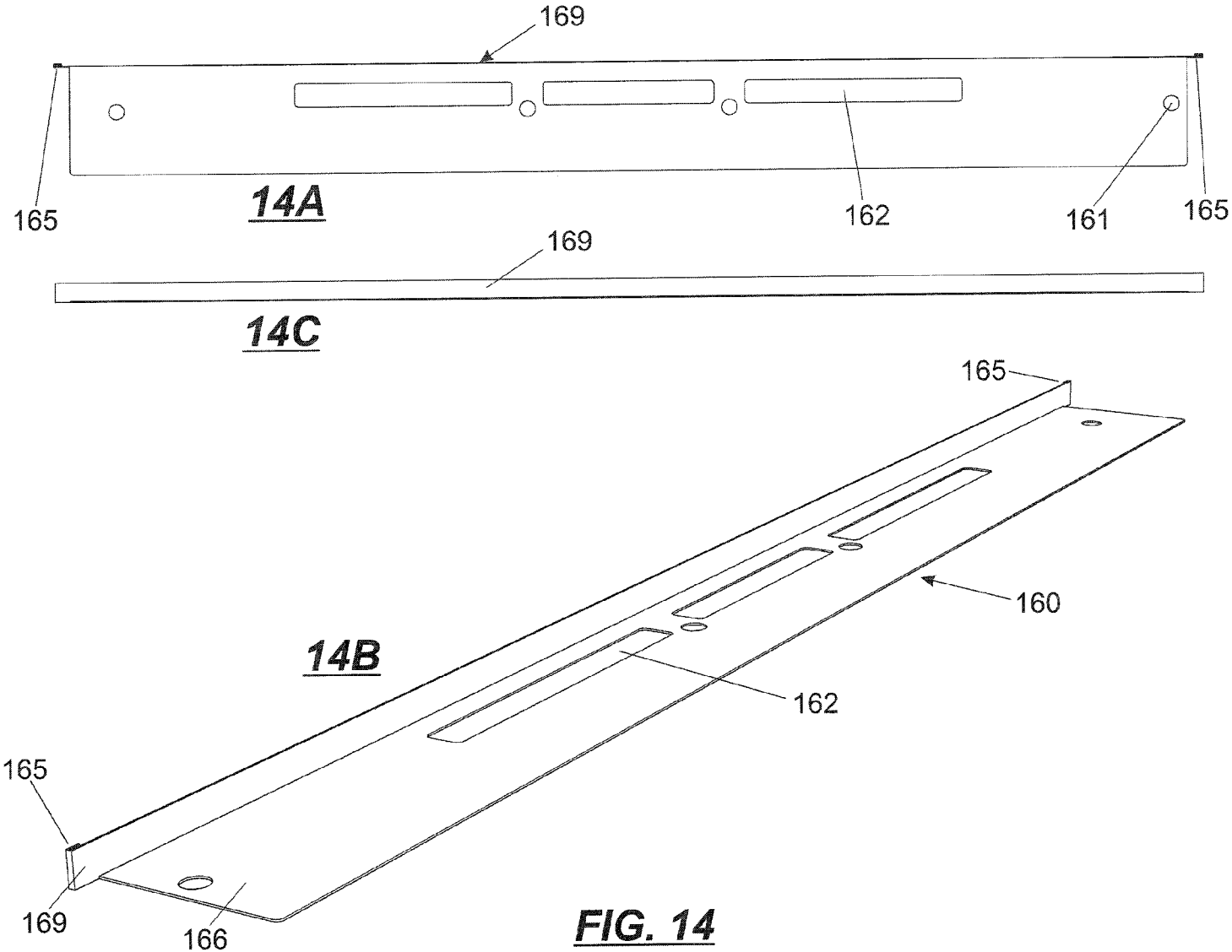
Figure 15:
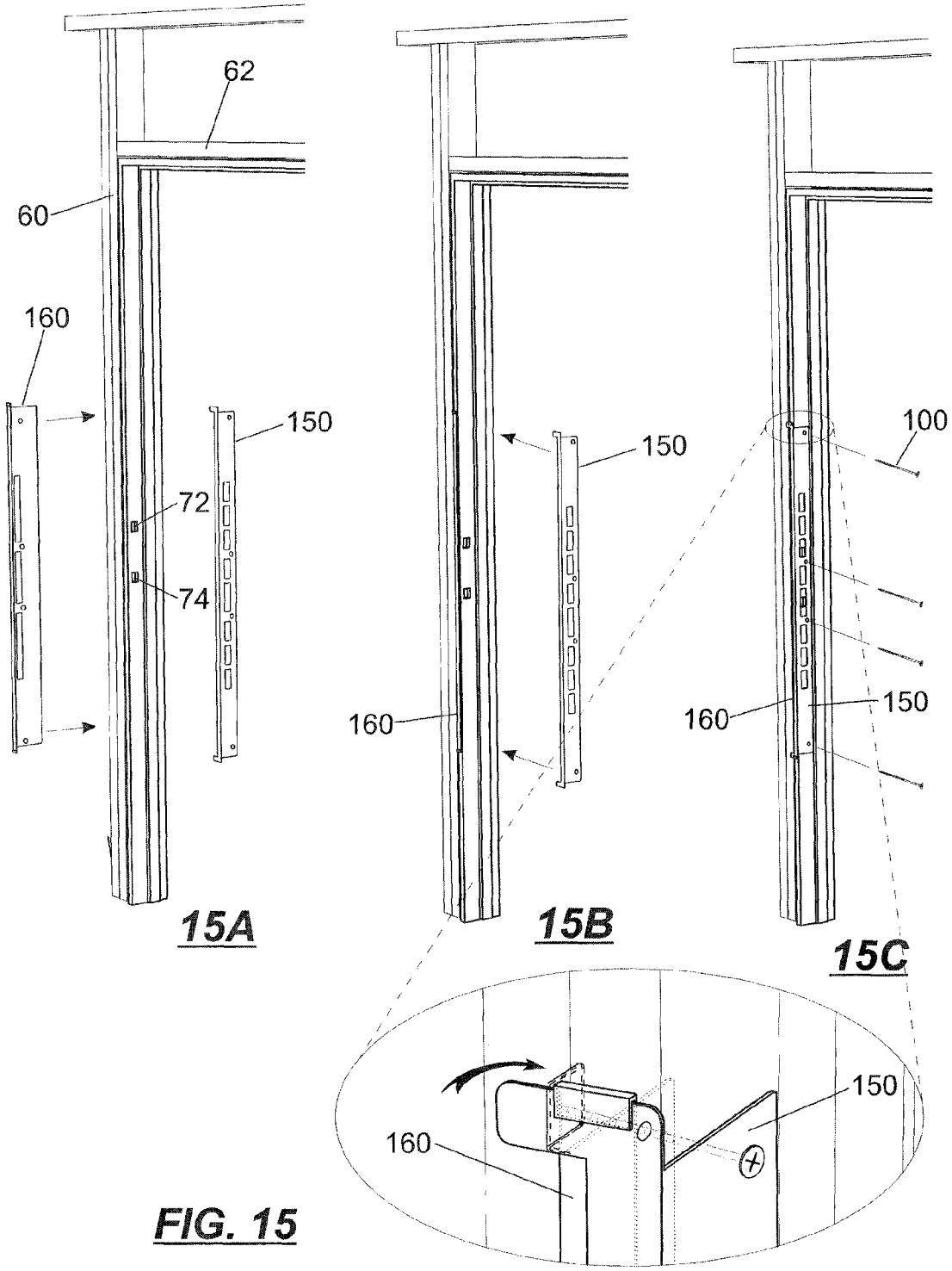

FIG. 12 is a front elevation view of an entry door assembly without any trim molding mounted around the doorway, featuring alternative shield components.

FIGS. 13, 13A, 13B and 13C are front elevation, perspective, and side views of the medial section of a door jamb shield for use on the free swinging door side of an entry door assembly.

FIGS. 14, 14A, 14B and 14C are front elevation, perspective, and side views of the lateral half a door jamb shield for use on the free swinging door side of an entry door assembly.

FIGS. 15, 15A, 15B and 15C are perspective views of a portion of a door jamb and door jamb shield corresponding to the free swinging door edge of an entry door assembly.

DETAILED DESCRIPTION OF THE INVENTION

The present invention now will be described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 5:
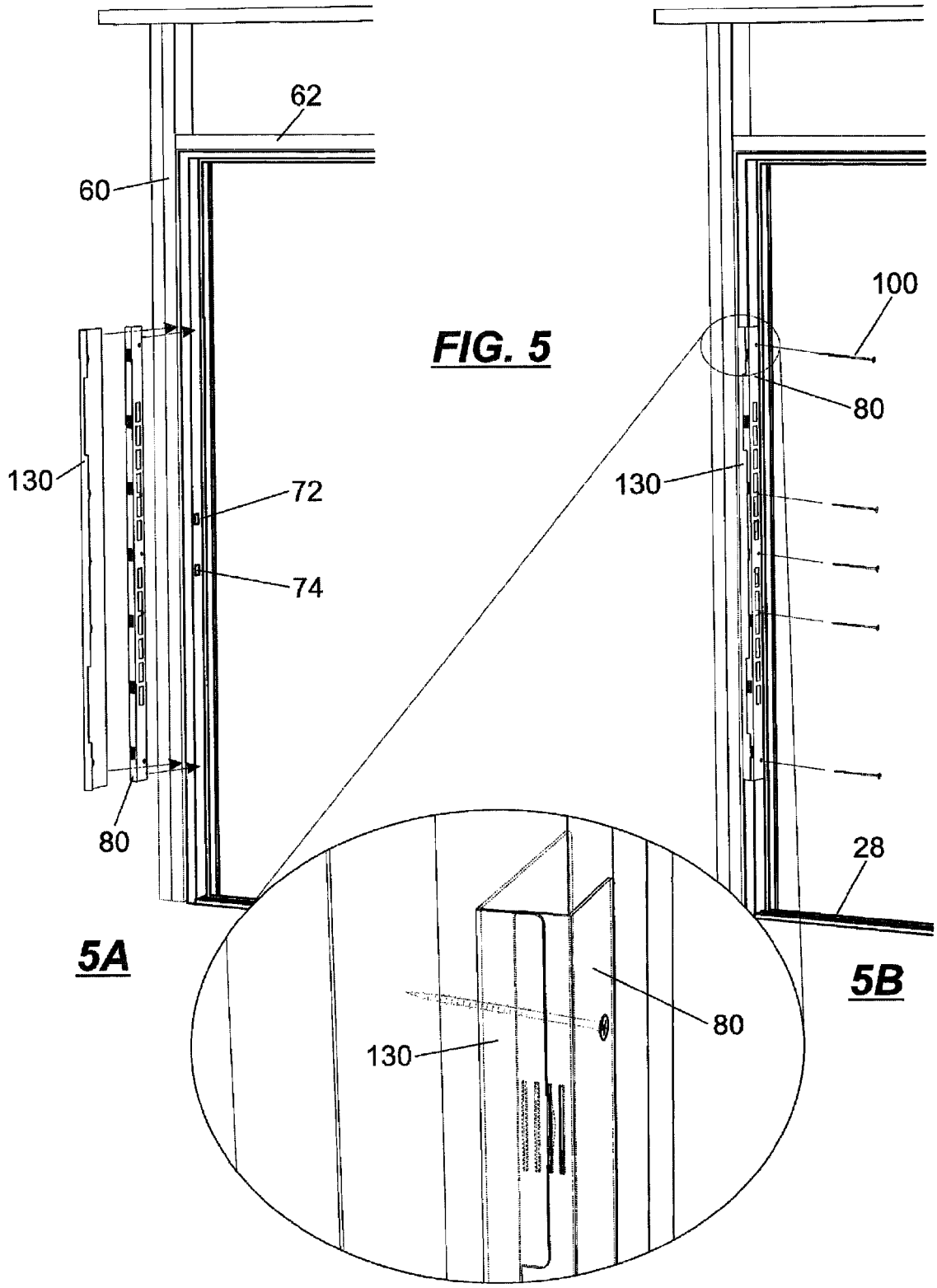
Figure 6:
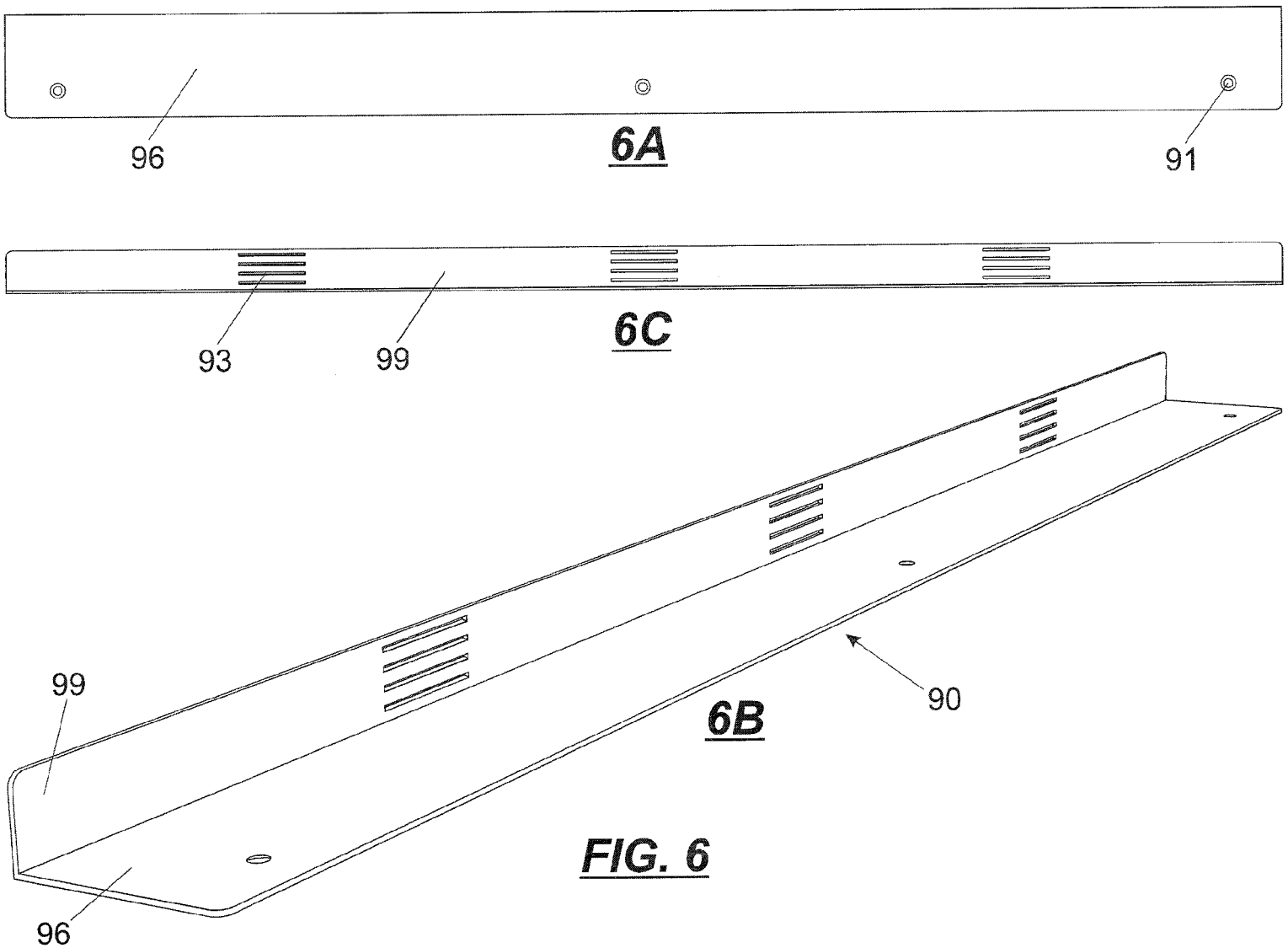

The present invention described and further detailed herein is particularly useful as a security device for the reinforcement of new door assemblies and, because of the ability to be adjustable, is equally suited for the repair of entry door assemblies with non-standard dimensions, while the door assembly remains in place. In place refers to the door assembly as mounted in an existing structure with means having been taken to ensure fixation to the structure in the current location. Accordingly a door assembly, as shown in FIGS. 1, 1A and 1B and FIG. 2, shall be an assembly including a door slab (10) that is hingedly affixed (using hinges (24)) along one vertically elongated edge to the hinge-side vertical jamb member (12), thereby allowing the door slab to swing and thus accommodate opening and closure. As well the door slab (10) shall have locking hardware (30)(50) mounted near the vertical free swinging edge (11) so that the locking hardware may interface closely with the adjacent free-swinging side vertical door jamb member (14) upon door closure and lock actuation. Lock hardware shall typically involve a dead bolt (30) that has the locking mechanism (32) (34) (52) (54), as seen in FIGS. 10A and B, mounted both on the interior face (13) and exterior face (15) of the door and is manually manipulated by a key to lawfully unlock the door from the exterior side. A knob or key may be used to control the operation of the dead bolt lock bolt (36) from the interior side to engage and disengage lock bolt plunger (38) from the receiving opening (72 of FIG. 5A) of the free-swinging side vertical door jamb member (14). The lock bolt assembly (36) will extend perpendicularly, internal to the door slab, from the union of locking mechanisms (32)(34) on the door slab facing to the free swinging edge (11) where it is typically secured. A similarly arranged and actuated latch bolt assembly (50) shall be positioned some distance below the dead bolt (30) allowing the bolt plunger (58), of the latch bolt (56), to catch and remain engaged in the receiving opening (74 of FIG. 5A) of the free-swinging side vertical door jamb member (14), while the door is closed. The bolt plunger (58) of the latch bolt (56) can be retracted by manipulation of the door knobs (52)(54) that will be positioned on the interior and exterior faces of the door (13) (15), according to typical placement. The latch bolt locking assembly (50) is typically designed to accept a key, for lawful entry, in the exterior locking mechanism (53) positioned in the center in the door knob. The interior door knob (54) will be assembled with a manually operated knob (not illustrated), centrally located, that can be fingered to lock and unlock the latch bolt; thereby allowing for turning of the door knobs (52) (54) to disengage the latch bolt plunger (58) from the corresponding strike plate (26) and receiving (74) opening in the door jamb member (14).

The door jamb members shall ordinarily comprise opposing vertical jamb members (12)(14) that will be joined together by upper and lower common horizontal jamb members (22) (28). Each jamb member on its facing surface will include an offset surface (70) along its length which will cause the member to recess and have two distinct planes along the facing surface (71) into which a weather barrier is mounted. The offset surface (70) shall serve as a sealing surface for the exterior door slab face (15) as well it will be a stop for the free swinging edge (11), in the closed position. The vertical and upper jamb members (12)(14) (22) are typically of wooden composition, while the lower member (28) may be similarly created or of variable materials more resistant to weather related long term damage.

A pair of wooden vertical stud members (60) shall be immediately adjacent and parallel to the vertical jamb members (12) (14), separated only by positioning shims (64). These studs (60) will be interposed between the walls of the structure (66) and joined together above and below the door jamb by a common header (62) and common floor (68) respectively to form the rough frame (60) (62) (68). The door assembly detail in FIG. 2 including the door enclosure (12) (14)(22)(28) is securely affixed in the rough frame (60) (62) (68), positioned true with shims (64) to ensure proper alignment, and secured with suitable attaching hardware. Decorative molding (not illustrated) shall conceal the area immediately around the door jamb (12)(14)(22)(28) on the inner, outer walls (60) and extends along floor (68) of the structure.

Subsequently the door slab (10), on the affixed edge (17), is attached to the doorjamb stanchion with common hinge assemblies (24) secured by relatively short screws that are ordinarily shallowly set in the soft wood substrate of the hinge-side vertical doorjamb member (12). The plunger portion of both lock bolts (38)(58) pass through a strike plate (not illustrated) of conventional construction and similarly mounted on the free-swinging side vertical jamb member (14), then engage the free-swinging side vertical doorjamb member (14) and engaging the bolt receiving openings (72) (74), very near the interior edge of engage the free-swinging side vertical doorjamb member (14). Typically the bolt plunger of the dead bolt (38) will penetrate more deeply into the vertical door jamb member than the bolt plunger of the latch bolt (58) and consequently requires the receiving opening to be suitably sized.

Embodiments of the present invention provide a means for providing an adjustable door assembly security device that secures, reinforces and repairs a door assembly. The embodiment of FIG. 2 will demonstrate a security system including door jamb stanchion, door jamb member and door slab improvement shields suitably situated on a door assembly. The attached figures are examples of the mounting components in accordance with the current invention.

As seen in FIGS. 3A-C, 4A-C and FIGS. 5A and B, the jamb shielding component corresponding to the free swinging side of the door comprises two vertically elongated, substantially equal length members having basically "L" shaped cross sections. The members are constructed of about 16-24 gauge steel sheet metal, and fit together to form a slide-on sleeve. When positioned together, the members (80)(130) form a metal elongated sleeve shaped in a manner so as to generally present a J shaped cross section. The first or medial member (80) comprises a medial side panel (86) and an interior side panel (89). The medial side panel (86) of the medial member (80) of the free-swinging side jamb shielding component extends, in close proximity, along the offset plane (76) of the facing surface (71) of the vertical jamb member (14). The interior side panel (89) of the medial member (80) of the shielding component is then contoured to advance perpendicular to the medial side panel (86), flushly contacting the interior surface (78) of the doorjamb member (14). The interior side panel (89) of the medial member (80) has a plurality of slots (83) positioned side by side in groups, with the groups of slots being spaced vertically along the length (while FIG. 3 illustrates seven groups of four slots each, the number and spacing of the slots may vary). The second or lateral member (130) comprises an interior side panel (139) and a lateral side panel (136). The interior side panel (139) of the lateral member (130) partially overlaps and engages with (in a manner described in more detail below) the interior side panel (89) of the medial member (80), thereby forming a unified common center section that flushly contacts and covers the interior surface (78) of the vertical jamb member (14). The lateral side panel (136) of the lateral member (130) bends perpendicular to the interior side panel (139) to be positioned along and flushly contacting the lateral surface of the vertical door jamb member (14) immediately adjacent the corresponding vertical stud of the rough frame (60). The lateral member (130) has tabs (132) positioned along the length of the interior side panel (136). The tabs are on the edge of the interior side panel (139) that is opposite the edge that meets the lateral side panel (136). The tabs extend substantially perpendicular to the interior side panel (139), such that the tabs are substantially parallel to the lateral side panel (136). The spacing of the tabs along the edge of the interior side panel of the lateral member (130) corresponds to the spacing of the groups of slots along the length of the interior side panel of the medial member (80), such that each tab will extend through a slot in the corresponding group of slots when the two sections are mounted on the door jamb member and engage the interior edge (78) of the vertical jamb section (14). The tabs may be pointed, as illustrated in FIG. 4, to enable the tabs to easily penetrate the wooden jamb member. Which slot in each group that a tab extends through depends on the thickness of the jamb member. Having multiple slots in each group enables the device to mount to jamb members of different thicknesses. The medial member (80) will have multiple countersunk openings (81) along the medial side panel (86) into which the mounting hardware (100) is secured. As well there will be a plurality of substantially identically sized cutouts or knockouts (82) approximately centered and aligned vertically along the length of the medial side panel. A number of the knockouts or cutouts are provided, such that at least some will directly coincide with the lock bolt plunger receiving openings (72) (74) of the corresponding vertical door jamb stanchion (14).

The free-swinging side jamb shielding component (80) (130), once assembled, will be incorporated onto the vertical doorjamb member in the area of the narrowed offset plane (76) specific to the central region of the vertical jamb member. The component will be arranged such that the common center section (i.e., the engaged and partially overlapping interior side panels (89)(139)) of the elongated metal sleeve (80) (130), created by the engagement of the tabs of the lateral member (130) into the slots of the medial member (80) and the coinciding perpendicular bends of the sections, will be facing the interior edge of the vertical door jamb member (14) previously detailed. The medial side panel (86) of the medial member (80) of the metal sleeve will extend onto the offset plane (76) of the vertical door jamb member facing surface (71) with its extreme edge (i.e., the edge opposite the edge that is shared with the interior side panel (89)) coming to rest flush against the offset surface (71) while maintaining a close parallel orientation to the offset plane (76). The lateral member (130) will extend along closely and be parallel to the same vertical doorjamb member's posterior or lateral region. The common center section, created by the engagement and partial overlapping of the interior side panels of the lateral and medial members, connects the lateral and medial members after engaging the tabs of one into the slots of the other so that the medial side panel of the medial member and the lateral side panel of the lateral member are substantially parallel to each other. The distance between the medial side panel of the medial member and the lateral side panel of the lateral member is adjustable as described above (based on which slots the tabs go into) such that the distance is substantially the same as the thickness of the doorjamb when applied.

Accordingly when the free-swinging side jamb shielding component is arranged as previously mentioned the position is adjusted such that the medial member (80) generally aligns with the vertical center of the corresponding vertical doorjamb member (14) (as seen in FIG. 5A). The lateral member (130) is then arranged as previously mentioned and is engaged with the medial member. When thusly positioned the component is secured with suitable mounting hardware. Accordingly when the jamb shielding component is arranged as previously mentioned, the position is adjusted such that the knockouts (82) in the medial member (80) correspond, with specific alignment, to the bolt plunger receiving holes (72) (74) in the corresponding vertical door jamb member (14). When correctly positioned, the knockouts that align with the bolt plunger receiving holes (72) (74) are removed and the component is secured with suitable mounting hardware. This mounting hardware will comprise screws (100) that are placed in the countersunk openings (81) along the medial side panel of the jamb shielding component (80). Additionally, the tabs (132) of the lateral member (130) also help to secure the medial member (80) in position. After properly preparing the material immediately beneath the countersunk opening (81), by means of pre-drilling (taking care to drill deep enough to create corresponding holes in the lateral side panel of the lateral member, as the lateral member does not comprise preexisting holes to receive the screws), the screws are received in the opening such that they pass through the medial member (80) of the jamb shield component, through the door jamb member (14), through the lateral member (130), through the shim material (64), and extend substantially into the rough frame (60) of the structure. When sufficiently engaged, the screw heads will come to rest in the countersunk opening (81) of the component and appear to be in the same plane.

As mentioned above, the medial member (80) and the lateral member (130) of this embodiment are of substantially equal length. The length of these members is typically selected to be long enough to cover a substantial portion of the vertical jamb member (114) but short enough to be mountable on many different height door assemblies.

The featured embodiment of FIGS. 6A-C, 7A-C and FIGS. 8A and B relate to a hinge side jamb shield that comprises two elongated, substantially unequal length members (90)(130) having basically "L" shaped cross sections. The members are constructed of about 16-24 gauge steel sheet metal, and fit together to form a slide on-sleeve. When positioned together the members form a metal elongated sleeve shaped in a manner so as to generally present a J shaped cross section. The first or medial member (90) comprises a medial side panel (96) and an interior side panel (99). The medial side panel (96) of the medial member (90) extends, in close proximity, along the offset plane (76) of the facing surface (71) of the vertical jamb member (12). The medial member (90) will be formed with a substantially shorter length than the lateral member (130) and be centrally located when attached to the lateral member (130), to accommodate being positioned between the fixed portion of two of the hinges (24) attached to the vertical jamb section (12). The interior side panel (99) of the medial member (90) is then contoured to advance perpendicular to the medial side panel (96), flushly contacting the interior surface (78) of the doorjamb member (12). The interior side panel (99) of the medial member (90) has a plurality of slots (93) positioned side by side in groups, with the groups being spaced vertically along the length (while FIG. 6 illustrates three groups of four slots each, the number and spacing of the slots may vary). The second or lateral member (130) comprises an interior side panel (139) and a lateral side panel (136). The interior side panel (139) comprises two hinge cutouts (138) to enable the lateral member to be mounted on the jamb member without interfering with the hinges. The interior side panel (139) of the lateral member (130) partially overlaps and engages with (in a manner described in more detail below) the interior side panel (99) of the medial member (90), thereby forming a unified common center section that flushly contacts and covers the interior surface (78) of the vertical jamb member (12). The lateral side panel (136) of the lateral member (130) bends perpendicular to the interior side panel (139) to be positioned along and flushly contacting the lateral surface of the vertical door jamb member (12) immediately adjacent the corresponding vertical stud of the rough frame (60). The lateral member (130) has tabs (132) positioned along the length of the interior side panel (136). The tabs are on the edge of the interior side panel (139) that is opposite the edge that meets the lateral side panel (136). The tabs extend substantially perpendicular to the interior side panel (139), such that the tabs are substantially parallel to the lateral side panel (136). The spacing of the tabs along the edge of the interior side panel of the lateral member (130) corresponds to the spacing of the groups of slots along the length of the interior side panel of the medial member (90), such that each tab will extend through a slot in the corresponding group of slots when the two sections are mounted on the door jamb member and engage the interior edge (78) of the vertical jamb section (12). The tabs may be pointed, as illustrated in FIG. 7, to enable the tabs to easily penetrate the wooden jamb member. Which slot in each group that a tab extends through depends on the thickness of the jamb member. Having multiple slots in each group enables the device to mount to jamb members of different thicknesses. The medial member (90) will have multiple countersunk openings (91) along the medial side panel (96) into which the mounting hardware (100) is secured.

The hinge-side jamb-shielding component (90)(130) will be incorporated onto the vertical doorjamb member (12) in the area of the narrowed offset plane (76) specific to the central region of the vertical jamb member. The component will be arranged such that the common center section (i.e., the engaged and partially overlapping interior side panels (99)(139)) of the elongated metal sleeve (90)(130) created by the engagement of the tabs of the lateral member (130) into the slots of the medial member (90) and the coinciding perpendicular bends of the sections, will be facing the interior edge (78) of the vertical door jamb member (12) previously detailed. The medial side panel (96) of the medial member (90) of the metal sleeve (90)(130) will extend onto the offset plane (76) of the vertical door jamb member facing surface (71) with its extreme edge (i.e., the edge opposite the edge that is shared with the interior side panel (99)) coming to rest flush against the offset surface (71) while maintaining a close parallel orientation to the offset plane (76). The lateral member (130) will extend along closely and be parallel to the same vertical doorjamb member's posterior or lateral region. The common center section (99)(139), created by the engagement and partial overlapping of the interior side panels of the lateral and medial members, connects the lateral and medial members after engaging the tabs of one into the slots of the other so that the medial side panel of the medial member and the lateral side panel of the lateral member are substantially parallel to each other. The distance between the medial side panel of the medial member and the lateral side panel of the lateral member is adjustable as described above (based on which slots the tabs go into) such that the distance is substantially the same as the thickness of the doorjamb when applied.

Accordingly when the hinge-side jamb shielding component is arranged as previously mentioned the position is determined such that the medial member (90) is generally positioned between the middle and bottom hinges on the vertical doorjamb member (12) (as seen in FIGS. 8A and B). The hinge-side jamb shielding component could be positioned with the medial member positioned between the middle and top hinges, but the lower portion of the door is more likely to receive a kicking force from an intruder and therefore is more desirable to strengthen. The lateral member (130) is then arranged as previously mentioned and is engaged with the medial member. When thusly positioned the component is secured with suitable mounting hardware. This mounting hardware will comprise screws (100) that are placed in the countersunk openings (91) along the medial side panel of the jamb shielding component (90). Additionally, the tabs (132) of the lateral member (130) also help to secure the medial member (90) in position. After properly preparing the material immediately beneath the countersunk opening (91), by means of pre-drilling (taking care to drill deep enough to create corresponding holes in the lateral side panel of the lateral member, as the lateral member does not comprise preexisting holes to receive the screws), the screws are received in the opening such that they pass through the medial member (90), through the door jamb member (14), through the lateral member (130), through the shim material (64), and extend substantially into the rough frame (60) of the structure. When sufficiently engaged the screw heads will come to rest in the countersunk opening (81) of the component and appear to be in the same plane.

Figure 7:
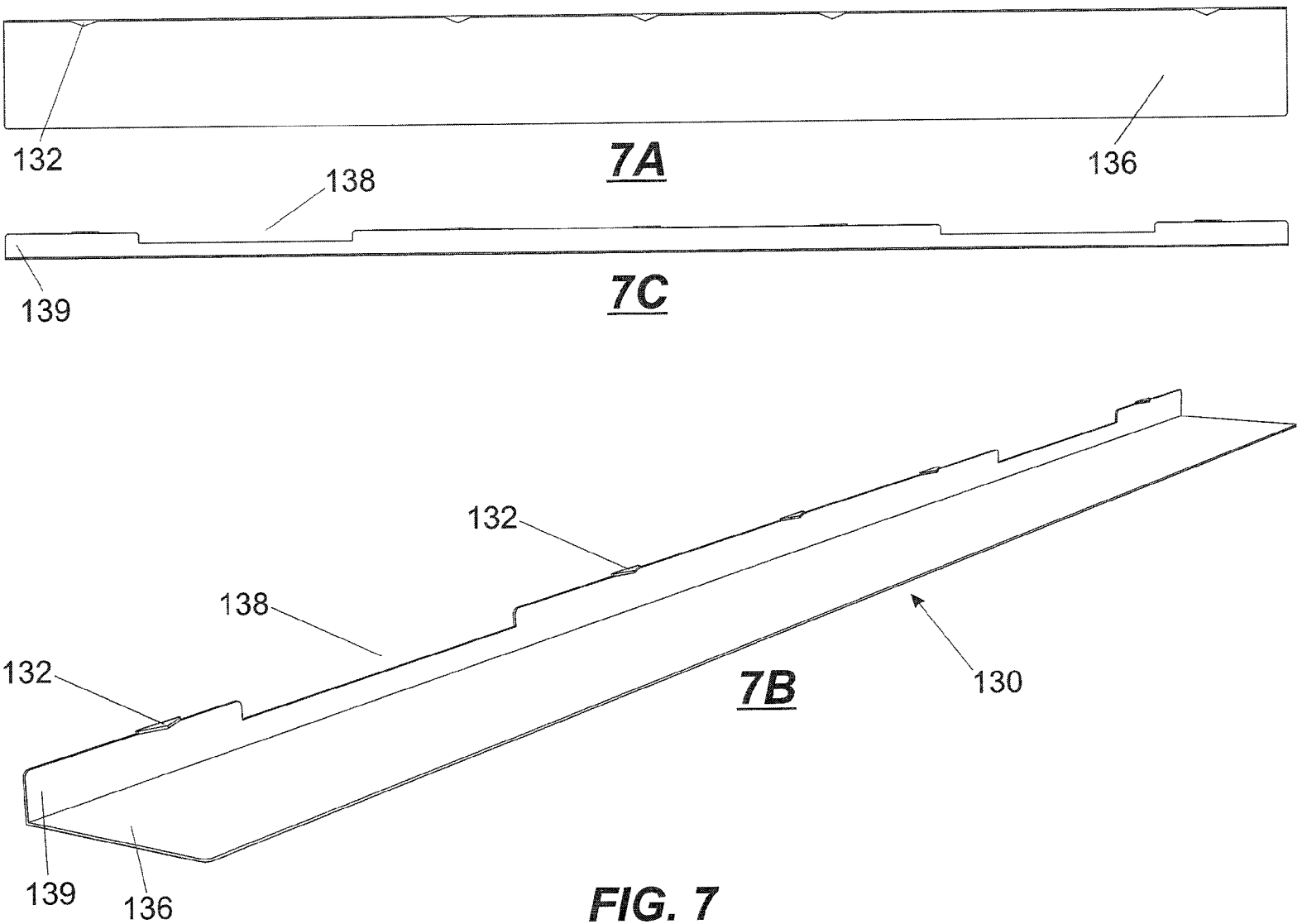
Figure 8:
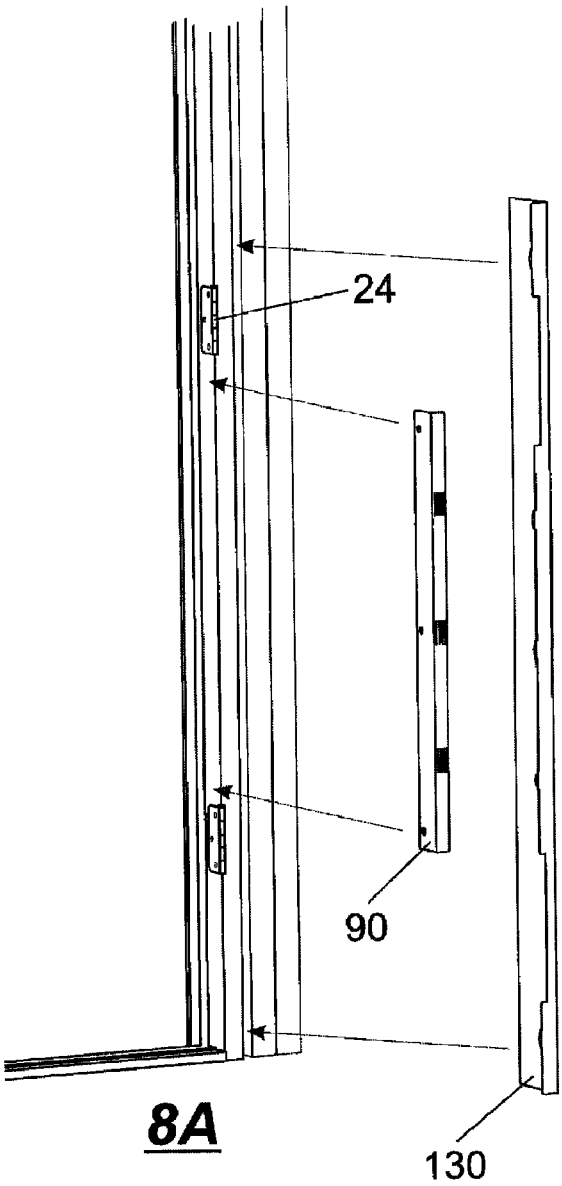
Figure 8:
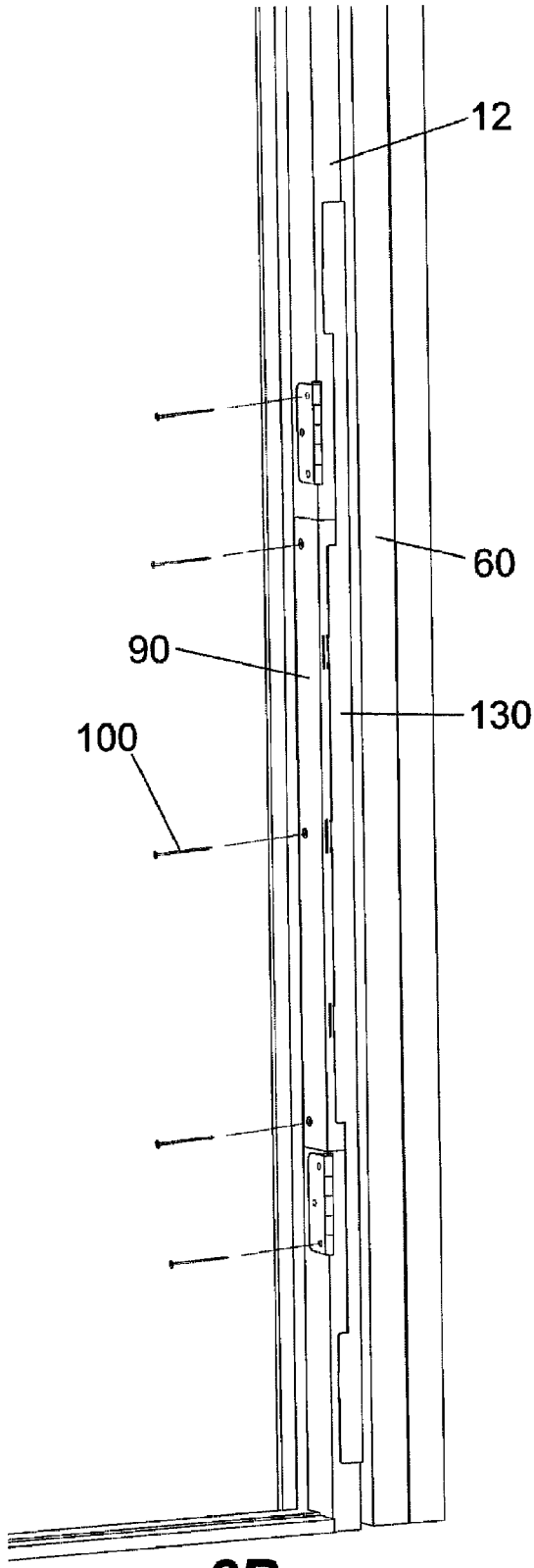
Figure 9:
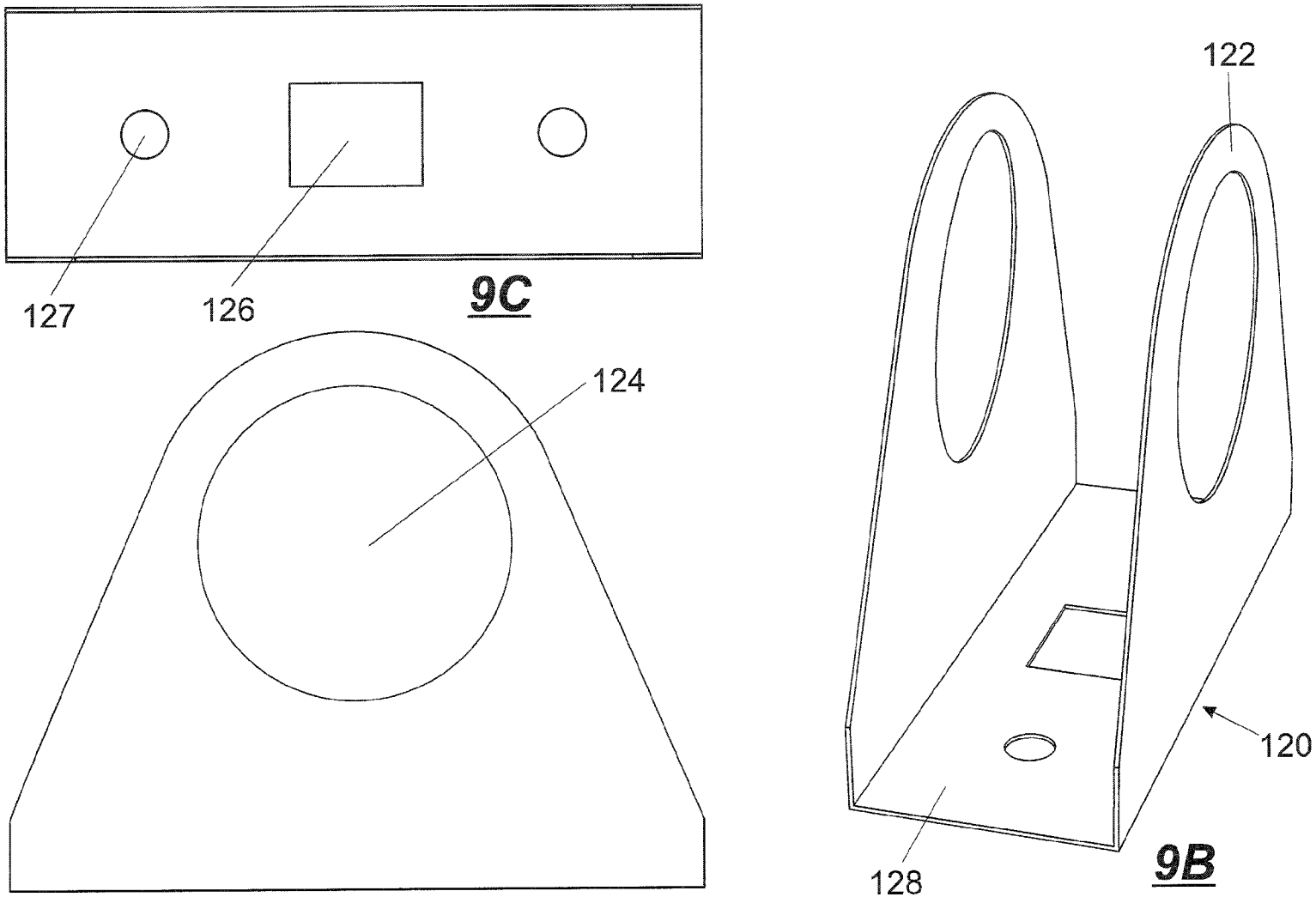

In an alternative embodiment of the invention, lateral member (130) is long enough to span all three hinges and has three hinge cutouts (rather than two as in the embodiment illustrated in FIG. 7). In this embodiment, two medial members (90) will be used to engage with the longer lateral member—one medial member being positioned between the middle and bottom hinges and one medial member being positioned between the middle and top hinges.

Note that, in the illustrated embodiment of the invention, the lateral member of the free-swinging side shield and the lateral member of the hinge-side shield are identical. This enables one stock keeping unit (SKU) to be used for two different purposes, thereby reducing manufacturing and inventory costs. The hinge cutouts (138), which are necessary on the hinge-side shield, are included on the free-swinging side shield (even though they are not necessary) to enable this identicalness.

As represented in FIGS. 9A-C and FIGS. 10A and B, the door shielding component of the present invention is an elongated steel sleeve (120) that is shaped in a manner to have a common center section closely abutted to the free swinging edge (11) of the door slab. The sleeve will be constructed with openings (126) in this common center section that are positioned to coincide with specific alignment and accommodate the lock bolt plunger (38) (58) operation as it is manipulated to extend and retract from the door slab edge (11) while respectively engaging and disengaging the corresponding vertical jamb member (14). The door shield component is further contoured to have perpendicular side panels (122 paralleling and in close proximity to the large facing surfaces of the door slab (13) (15). The panel (122) have openings (124) of sufficiently sized for installation of typical locking devices (30) (50) as previously detailed. The component will be arranged such that the open section of the elongated metal sleeve created by the fore mentioned coinciding perpendicular bends of the sleeve will be immediately against the free swinging edge of the door slab (11). In this position the openings (126) in this portion will coincide with specific alignment of the lock bolt plungers (38) (58), thereby permitting it to be manipulated to extend and retract from the door slab edge (11) while respectively engaging and disengaging the corresponding vertical jamb member (14). The side panels (122) extend, snugly against the interior and exterior facing surfaces (13) (15), towards the fixed edge of the door slab (17). Openings 127 in the common center section receive fasteners to secure the door shielding component to the door slab edge (11).

FIGS. 1 through 15 are representative of alternate configurations of the jamb and hinge shielding components. Basically the major variation being represented in these drawing involves how the medial and lateral members engage. As in the above described embodiment, this configuration allows the two-part sleeve to be mechanically and slidably adjustable to accommodate substantial variations in jamb thickness and still be arranged on the door assembly as previously detailed. This feature will allow for positional or slidable adjustment of said components with respect to a given jamb thickness. Alternative construction in this manner permits use of the jamb shielding components in cooperation with the alternate embodiments of the door assemblies.

FIGS. 11 through 15 depict a jamb shielding component corresponding to the free swinging side of the door that comprises two vertically elongated, substantially equal length members having basically "L" shaped cross sections. The members are constructed of about 16-24 gauge steel sheet metal, and fit together to form a slide-on sleeve. When positioned together the members (150)(160) form a metal elongated sleeve shaped in a manner so as to generally present a J shaped cross section. The first or medial member (150) comprises a medial side panel (156) and an interior side panel (159). The interior side panel (159) comprises tabs (155) at either end. The tabs are planar and contiguous with the interior side panel and extend outward (i.e., away from the edge shared with the medial side panel (156)) perpendicular to the longitudinal axis of the interior side panel. The second or lateral member (160) comprises a lateral side panel (166) and an interior side panel (169). The interior side panel (169) of the lateral member (160) comprises slots (165) at either end for receiving corresponding tabs of the medial member. The opposite ends of interior side panel (169) extend beyond the corresponding ends of the lateral side panel (166). Both of these two extended portions are folded into a J shape to form the slots.

The medial side panel (156) of the medial member (150) of the free-swinging side jamb shielding component of this alternative embodiment extends, in close proximity, along the offset plane (76) of the facing surface (71) of the vertical jamb member (14). The interior side panel (159) of the medial member (150) is then contoured to advance perpendicular to the medial side panel (156), flushly contacting the interior surface (78) of the doorjamb member (14). The interior side panel (169) of the lateral member (160) engages with (by receiving the tabs of the medial member in its slots (165)) the interior side panel (159) of the medial member (150), thereby forming a unified common center section that flushly contacts and covers the interior surface (78) of the vertical jamb member (14). The lateral side panel (166) of the lateral member (160) bends perpendicular to the interior side panel (169) to be positioned along and flushly contacting the lateral surface of the vertical door jamb member (14) immediately adjacent the corresponding vertical stud of the rough frame (60). The tabs (155) slide through the slots (165) and then fold in to flushly contact the lateral surface of the door jamb member (as illustrated in FIG. 11A and in the inset of FIG. 15C). The component will have multiple countersunk openings (151) along the medial side panel (156) of the medial member (150) into which the mounting hardware (100) is secured. Multiple (non-countersunk) openings (161) are positioned along the lateral side panel (166) of the lateral member (160) to correspond to the multiple countersunk openings (151) along the medial side panel (156) of the medial member (150). Openings (161) are larger than openings (151), because openings (161) are designed to merely enable the fasteners to pass unimpeded through the lateral member (160) into the underlying structure as discussed in more detail below. The larger size of openings (161) provides sufficient tolerance for this unimpeded passage without requiring precise mounting alignment of the lateral and medial members. As well there will be a plurality of substantially identically sized cutouts or knockouts (152) approximately centered (relative to the longitudinal axis) and aligned vertically along the length of the medial side panel (156). A number of the knockouts or cutouts are provided, such that at least some will directly coincide with the lock bolt plunger receiving openings (72) (74) of the corresponding vertical door jamb stanchion (14).

The jamb shielding component (150)(160), once assembled, will be incorporated onto the vertical doorjamb member in the area of the narrowed offset plane (76) specific to the central region of the vertical jamb member. The component will be arranged such that the common center section (159)(169) of the elongated metal sleeve (150)(160), created by slidably engaging the tabs of the medial member into the slots of the lateral member and the coinciding perpendicular bends of the sections, will be facing the interior edge (78) of the vertical door jamb member (14) previously detailed. The medial member (150) of the metal sleeve will extend onto the offset plane (76) of the vertical door jamb member facing surface (71) with its extreme edge (i.e., the edge opposite the edge that is shared with the interior side panel (159)) coming to rest flush against the offset surface (71) while maintaining a close parallel orientation to the offset plane (76). The lateral member (160) will extend along closely and be parallel to the same vertical doorjamb member's lateral surface. The common center section (159) (169), created by the engagement of the interior side panels of the medial and lateral members, connects the medial and lateral members after engaging the tabs of one into the slots of the other so that the medial side panel of the medial member and the lateral side panel of the lateral member are substantially parallel to each other. The distance between the medial side panel of the medial member and the lateral side panel of the lateral member is adjustable (based on how far the tabs slide into the slots) such that the distance is substantially the same as the thickness of the doorjamb. Accordingly when the jamb shielding component is arranged as previously mentioned the position is adjusted such that the medial member (150) generally aligns with the vertical center of the corresponding vertical doorjamb member (14). When the jamb shielding component is arranged, the position is adjusted such that the knockouts (152) in the medial member (150) correspond, with specific alignment, to the bolt plunger receiving holes (72) (74) in the corresponding vertical door jamb member (14). When correctly positioned, the knockouts that align with the bolt plunger receiving holes (72) (74) are removed and the component is secured with suitable mounting hardware. Elongated rectangular cutouts (162) of the lateral side panel (166) of the lateral member (160) enable the lock bolts (where necessary and/or desirable) to pass through the lateral member (160) into the underlying frame structure, thereby providing even further installation flexibility, strength and security. When thusly positioned the component is secured with suitable mounting hardware. This mounting hardware will comprise screws (100) that are placed in the countersunk openings (151) along the medial side panel (150). Additionally, the subsequent bending of the tabs (155) around the lateral surface of the door jamb member also help to secure the medial member (150) in position. After properly preparing the material immediately beneath the countersunk opening (151), by means of pre-drilling, taking care to drill straight and deep enough to pass through the corresponding pre-existing holes (162) in the lateral side panel of the lateral member, the screws are received in the opening such that they pass through the medial side panel (156) of the medial member (150), through the door jamb member (14), through the pre-existing holes (162) in the lateral side panel (166) of the lateral member (160), through the shim material (64), and extend substantially into the rough frame (60) of the structure. When sufficiently engaged, the screw heads will come to rest in the countersunk opening (151) of the component and appear to be in the same plane.

In use, the present system of invention can be characterized by its ease of installation, adaptability, superior design and simplicity. Briefly the steps for installation follow: Remove interior trim modeling and strike plates. Assemble the jamb shielding components so they are appropriately sized for the particular jamb member. Position the jamb shielding components (80) (130) (90) (130) or (150) (160), ensuring the line up with the lock bolt plungers openings (72) (74). Form holes in the corresponding door jamb member for reception of screws at locations (81). Secure the jamb shielding components in place with suitable screws (100). Position the hinge side jamb shielding components (90)(130) and form holes in the corresponding door jamb (12)(14), as detailed, for the reception of screws. Secure the hinge side jamb shield in place as detailed with suitable screws. Remove the locking devices (30) (50) from the door slab surfaces (13) (15). Position the door shield component on the door slab free swinging edge so as to allow the lock bolt plungers (38) (58) to pass through the corresponding openings in it (116). Secure the component in place with suitable screws and re-install the locking devices (30) (50) over the door shield component side panels (112), securing it in place.

The different shield components described herein are made of steel for strength reasons. Other metals or strong materials may alternatively be used to form the shields. Also, the actual dimensions of the various shield components may vary. The door jamb shield sleeve used for the door slab free swinging edge is from about six inches to about five feet long, or alternatively about one foot to three feet long, or in one example about twenty inches long. The corresponding side panels have widths of from about a half inch to about six inches. In one example, one side panel is about an inch wide, and the second side panel is about three inches wide. For a door jamb shield sleeve used on the door hinge side of the jamb, the sleeve is about four inches to two feet long, and in one example about six inches long. The side panels may have widths of from about a half inch to about six inches. In one example, one side panel is about an inch wide, and the second side panel is about three inches wide and are adjustable from about one half inch to about but not limited to three inches. The size and shape of the cutouts or knockouts are designed to correspond to the dimensions of the lock bolt receiving holes or hinge plate and are typically rectangular.

In applications involving repair of a door assembly, using the present invention, as much of the remaining door jamb member or door slab material as possible should be positioned to accept the appropriate components. When these door assemblies are severely damaged additional alignment maybe necessary to properly install the present system.

When the components of the present door security system are deployed alone or in combination as previously detailed they form a cohesive system that improves the security offered by a door assembly. The components reinforce and retrofit existing doors assemblies and as well repairs damaged assemblies of varied jamb thickness. These means are achieved by the components wrapping key elements of a door assembly in metal and securing them to the surrounding structure. The adjustable wrapping design reinforces these elements by placing metal along three sides of each piece and particularly along the typical load bearing surfaces exposed to a forced entry attempt, thereby preventing the splintering of the door assembly. The repair function allows for the door assembly elements to be easily repaired by sliding the door security components into place thereby wrapping the previously damaged areas even doors with non-standard component dimensions. This will also serve to conceal the prior damage. On a typical door assembly this means the door jamb members on either side of the assembly, and the door slab are wrapped in steel, while remaining in place, to repair or prevent further damage when substantial force is applied.

Having thus described and detailed the present invention, it is to be understood that many obvious and apparent variations in construction and arrangement may be made without departing from the overall scope and spirit thereof as defined by the appended claims. Furthermore, it is intended that the foregoing specifications and accompanying drawings be interpreted as illustrative rather than in a limiting sense.

That which is claimed:

1. A device for reinforcing a vertical jamb member of a door assembly, the vertical jamb member being adjacent a free-swinging side of a door, the device comprising:

a medial member comprising an elongated, single piece, metal sleeve, the sleeve comprising first and second side panels, the first and second side panels being substantially perpendicular to each other, the first side panel comprising a plurality of substantially rectangular cutouts therein for receiving a door dead bolt or door bolt plunger, the second side panel comprising engagement means; and a lateral member comprising an elongated, single piece, metal sleeve, the sleeve comprising first and second side panels, the first and second side panels being substantially perpendicular to each other, the second side panel comprising engagement means;

wherein the medial member is mounted on the vertical jamb member such that the first side panel of the medial member flushly contacts a medial surface of the vertical jamb member and such that the second side panel of the medial member flushly contacts an interior surface of the vertical jamb member;

wherein the lateral member is mounted on the vertical jamb member such that the first side panel of the lateral member flushly contacts a lateral surface of the vertical jamb member and such that the second side panel of the lateral member flushly contacts the interior surface of the vertical jamb member; and wherein the engagement means of the second side panel of the medial member engages the engagement means of the second side panel of the lateral member;

wherein the engagement means of the second side panel of the medial member comprises a plurality of substantially rectangular slots arranged in a plurality of groups, the plurality of groups spaced apart along a longitudinal axis of the medial member; each slot being arranged parallel to the longitudinal axis of the medial member and parallel to the other slots in the same group;

wherein the engagement means of the second side panel of the lateral member comprises a plurality of tabs, the tabs being spaced apart along a longitudinal axis of the lateral member, the longitudinal spacing of the tabs corresponding to the longitudinal spacing of the groups of slots on the medial member, each tab extending substantially perpendicularly from the second side panel such that the tabs are substantially perpendicular to the interior surface of the vertical jamb member when the lateral member is mounted on the vertical jamb member; and wherein each tab is received by a corresponding slot when the lateral member is mounted on the vertical jamb member, the corresponding slots being determined based on a width of the interior surface of the vertical jamb member.

2. The device of claim 1, wherein a length of the medial member and a length of the lateral member are substantially the same.

3. The device of claim 1, wherein a width of the first side panel of the lateral member is substantially greater than a width of the first side panel of the medial member, such that, when the engagement means of the second side panel of the medial member engages the engagement means of the second side panel of the lateral member and when the engaged medial and lateral members are mounted on the vertical jamb member, the engaged medial and lateral members have a J-shaped cross section.

4. The device of claim 1, wherein the first side panel of the medial member defines at least one opening for receiving a fastener to affix the member to the vertical jamb member.

5. A device for reinforcing a vertical jamb member of a door assembly, the vertical jamb member being adjacent a hinge side of a door, the device comprising:

a medial member comprising an elongated, single piece, metal sleeve, the sleeve comprising first and second side panels, the first and second side panels being substantially perpendicular to each other, the second side panel comprising engagement means; and a lateral member comprising an elongated, single piece, metal sleeve, the sleeve comprising first and second side panels, the first and second side panels being substantially perpendicular to each other, the second side panel comprising engagement means;

wherein the medial member is mounted on the vertical jamb member such that the first side panel of the medial member flushly contacts a medial surface of the vertical jamb member and such that the second side panel of the medial member flushly contacts an interior surface of the vertical jamb member;

wherein the lateral member is mounted on the vertical jamb member such that the first side panel of the lateral member flushly contacts a lateral surface of the vertical jamb member and such that the second side panel of the lateral member flushly contacts the interior surface of the vertical jamb member; and wherein the engagement means of the second side panel of the medial member engages the engagement means of the second side panel of the lateral member;

wherein the engagement means of the second side panel of the medial member comprises a plurality of substantially rectangular slots arranged in a plurality of groups, the plurality of groups spaced apart along a longitudinal axis of the medial member; each slot being arranged parallel to the longitudinal axis of the medial member and parallel to the other slots in the same group;

wherein the engagement means of the second side panel of the lateral member comprises a plurality of tabs, the tabs being spaced apart along a longitudinal axis of the lateral member, the longitudinal spacing of the tabs corresponding to the longitudinal spacing of the groups of slots on the medial member, each tab extending substantially perpendicularly from the second side panel such that the tabs are substantially perpendicular to the interior surface of the vertical jamb member when the lateral member is mounted on the vertical jamb member; and wherein each tab is received by a corresponding slot when the lateral member is mounted on the vertical jamb member the corresponding slots being determined based on a width of the interior surface of the vertical jamb member.

6. The device of claim 5, wherein a length of the medial member is determined to enable the medial member to fit either (i) between a middle hinge and a bottom hinge or (ii) between the middle hinge and a top hinge of the door assembly when mounted on the vertical jamb member; and wherein a length of the lateral member is determined to enable either (i) a top end of the lateral member to extend above the middle hinge and a bottom end of the lateral member to extend below the bottom hinge or (ii) the top end of the lateral member to extend above the top hinge and the bottom end of the lateral member to extend below the middle hinge.

7. The device of claim 5, wherein a width of the first side panel of the lateral member is substantially greater than a width of the first side panel of the medial member, such that, when the engagement means of the second side panel of the medial member engages the engagement means of the second side panel of the lateral member and when the engaged medial and lateral members are mounted on the vertical jamb member, the engaged medial and lateral members have a J-shaped cross section.

8. The device of claim 5, wherein the first side panel of the medial member defines at least one opening for receiving a fastener to affix the member to the vertical jamb member.

9. The device of claim 5, wherein the second side panel of the lateral member comprises at least one substantially rectangular cutout therein sized to correspond to a size of a door hinge barrel.

10. A system for reinforcing a door assembly, the door assembly comprising at least a door, a free-swinging side vertical jamb member, and a hinge-side vertical jamb member, the system comprising:

(I) a free-swinging side jamb shield, the free-swinging jamb side shield comprising:

a free-swinging side medial member comprising an elongated, single piece, metal sleeve, the sleeve comprising first and second side panels, the first and second side panels being substantially perpendicular to each other, the first side panel comprising a plurality of substantially rectangular cutouts therein for receiving a door dead bolt or door bolt plunger, the second side panel comprising engagement means; and a free-swinging side lateral member comprising an elongated, single piece, metal sleeve, the sleeve comprising first and second side panels, the first and second side panels being substantially perpendicular to each other, the second side panel comprising engagement means;

wherein the free-swinging side medial member is mounted on the free-swinging side vertical jamb member such that the first side panel of the free-swinging side medial member flushly contacts a medial surface of the free-swinging side vertical jamb member and such that the second side panel of the free-swinging side medial member flushly contacts an interior surface of the free-swinging side vertical jamb member;

wherein the free-swinging side lateral member is mounted on the free-swinging side vertical jamb member such that the first side panel of the free-swinging side lateral member flushly contacts a lateral surface of the free-swinging side vertical jamb member and such that the second side panel of the free-swinging side lateral member flushly contacts the interior surface of the free-swinging side vertical jamb member; and wherein the engagement means of the second side panel of the free-swinging side medial member engages the engagement means of the second side panel of the free-swinging side lateral member;

wherein the engagement means of the second side panel of the free-swinging side medial member comprises a plurality of substantially rectangular slots arranged in a plurality of groups, the plurality of groups spaced apart along a longitudinal axis of the free-swinging side medial member; each slot being arranged parallel to the longitudinal axis of the free-swinging side medial member and parallel to the other slots in the same group;

wherein the engagement means of the second side panel of the free-swinging side lateral member comprises a plurality of tabs, the tabs being spaced apart along a longitudinal axis of the free-swinging side lateral member, the longitudinal spacing of the tabs corresponding to the longitudinal spacing of the groups of slots on the free-swinging side medial member, each tab extending substantially perpendicularly from the second side panel such that the tabs are substantially perpendicular to the interior surface of the free-swinging side vertical jamb member when the lateral member is mounted on the free-swinging side vertical jamb member; and wherein each tab is received by a corresponding slot when the free-swinging side lateral member is mounted on the free-swinging side vertical jamb member, the corresponding slots being determined based on a width of the interior surface of the free-swinging side vertical jamb member; and (II) a hinge side jamb shield, the hinge jamb side shield comprising:

a hinge side medial member comprising an elongated, single piece, metal sleeve, the sleeve comprising first and second side panels, the first and second side panels being substantially perpendicular to each other, the second side panel comprising engagement means; and a hinge side lateral member comprising an elongated, single piece, metal sleeve, the sleeve comprising first and second side panels, the first and second side panels being substantially perpendicular to each other, the second side panel comprising engagement means;

wherein the hinge side medial member is mounted on the hinge side vertical jamb member such that the first side panel of the hinge side medial member flushly contacts a medial surface of the hinge side vertical jamb member and such that the second side panel of the hinge side medial member flushly contacts an interior surface of the hinge side vertical jamb member;

wherein the hinge side lateral member is mounted on the hinge side vertical jamb member such that the first side panel of the hinge side lateral member flushly contacts a lateral surface of the hinge side vertical jamb member and such that the second side panel of the hinge side lateral member flushly contacts the interior surface of the hinge side vertical jamb member; and wherein the engagement means of the second side panel of the hinge side medial member engages the engagement means of the second side panel of the hinge side lateral member;

wherein the engagement means of the second side panel of the hinge side medial member comprises a plurality of substantially rectangular slots arranged in a plurality of groups, the plurality of groups spaced apart along a longitudinal axis of the hinge side medial member; each slot being arranged parallel to the longitudinal axis of the hinge side medial member and parallel to the other slots in the same group;

wherein the engagement means of the second side panel of the hinge side lateral member comprises a plurality of tabs, the tabs being spaced apart along a longitudinal axis of the hinge side lateral member, the longitudinal spacing of the tabs corresponding to the longitudinal spacing of the groups of slots on the hinge side medial member, each tab extending substantially perpendicularly from the second side panel such that the tabs are substantially perpendicular to the interior surface of the hinge side vertical jamb member when the hinge side lateral member is mounted on the hinge side vertical jamb member; and wherein each tab is received by a corresponding slot when the hinge side lateral member is mounted on the hinge side vertical jamb member, the corresponding slots being determined based on a width of the interior surface of the hinge side vertical jamb member.

11. The system of claim 10, wherein a length of the free-swinging side medial member and a length of the free-swinging side lateral member are substantially the same.

12. The system of claim 10, wherein a width of the first side panel of the free-swinging side lateral member is substantially greater than a width of the first side panel of the free-swinging side medial member, such that, when the engagement means of the second side panel of the free-swinging side medial member engages the engagement means of the second side panel of the free-swinging side lateral member and when the engaged free-swinging side medial and lateral members are mounted on the free-swinging side vertical jamb member, the engaged free-swinging side medial and lateral members have a J-shaped cross section.

13. The system of claim 10, wherein a length of the hinge side medial member is determined to enable the hinge side medial member to fit either (i) between a middle hinge and a bottom hinge or (ii) between the middle hinge and a top hinge of the door assembly when mounted on the hinge side vertical jamb member; and wherein a length of the hinge side lateral member is determined to enable either (i) a top end of the hinge side lateral member to extend above the middle hinge and a bottom end of the hinge side lateral member to extend below the bottom hinge or (ii) the top end of the hinge side lateral member to extend above the top hinge and the bottom end of the hinge side lateral member to extend below the middle hinge.

14. The system of claim 10, wherein a width of the first side panel of the hinge side lateral member is substantially greater than a width of the first side panel of the hinge side medial member, such that, when the engagement means of the second side panel of the hinge side medial member engages the engagement means of the second side panel of the hinge side lateral member and when the engaged hinge side medial and lateral members are mounted on the hinge side vertical jamb member, the engaged hinge side medial and lateral members have a J-shaped cross section.

15. The system of claim 10, wherein the second side panel of the hinge side lateral member comprises at least one substantially rectangular cutout therein sized to correspond to a size of a door hinge barrel.

16. A method for reinforcing a vertical jamb member of a door assembly, the vertical jamb member being adjacent a free-swinging side of a door, the device comprising:

providing a medial member comprising an elongated, single piece, metal sleeve, the sleeve comprising first and second side panels, the first and second side panels being substantially perpendicular to each other, the first side panel comprising a plurality of substantially rectangular cutouts therein for receiving a door dead bolt or door bolt plunger, the second side panel comprising engagement means;

providing a lateral member comprising an elongated, single piece, metal sleeve, the sleeve comprising first and second side panels, the first and second side panels being substantially perpendicular to each other, the second side panel comprising engagement means;

mounting the medial member on the vertical jamb member such that the first side panel of the medial member flushly contacts a medial surface of the vertical jamb member and such that the second side panel of the medial member flushly contacts an interior surface of the vertical jamb member;

mounting the lateral member on the vertical jamb member such that the first side panel of the lateral member flushly contacts a lateral surface of the vertical jamb member and such that the second side panel of the lateral member flushly contacts the interior surface of the vertical jamb member; and engaging the engagement means of the second side panel of the medial member with the engagement means of the second side panel of the lateral member;

wherein the engagement means of the second side panel of the medial member comprises a plurality of substantially rectangular slots arranged in a plurality of groups, the plurality of groups spaced apart along a longitudinal axis of the medial member; each slot being arranged parallel to the longitudinal axis of the medial member and parallel to the other slots in the same group;

wherein the engagement means of the second side panel of the lateral member comprises a plurality of tabs, the tabs being spaced apart along a longitudinal axis of the lateral member, the longitudinal spacing of the tabs corresponding to the longitudinal spacing of the groups of slots on the medial member, each tab extending substantially perpendicularly from the second side panel such that the tabs are substantially perpendicular to the interior surface of the vertical jamb member when the lateral member is mounted on the vertical jamb member; and wherein each tab is received by a corresponding slot when the lateral member is mounted on the vertical jamb member the corresponding slots being determined based on a width of the interior surface of the vertical jamb member.

17. The method of claim 16, wherein a length of the medial member and a length of the lateral member are substantially the same.

18. The method of claim 16, wherein a width of the first side panel of the lateral member is substantially greater than a width of the first side panel of the medial member, such that, when the engagement means of the second side panel of the medial member engages the engagement means of the second side panel of the lateral member and when the engaged medial and lateral members are mounted on the vertical jamb member, the engaged medial and lateral members have a J-shaped cross section.

19. The method of claim 16, wherein the first side panel of the medial member defines at least one opening for receiving a fastener to affix the member to the vertical jamb member.

20. A method for reinforcing a vertical jamb member of a door assembly, the vertical jamb member being adjacent a hinge side of a door, the device comprising:

providing a medial member comprising an elongated, single piece, metal sleeve having an L-shaped cross section, the sleeve comprising first and second side panels, the first and second side panels being substantially perpendicular to each other, the second side panel comprising engagement means; and providing a lateral member comprising an elongated, single piece, metal sleeve, the sleeve comprising first and second side panels, the first and second side panels being substantially perpendicular to each other, the second side panel comprising engagement means;

mounting the medial member on the vertical jamb member such that the first side panel of the medial member flushly contacts a medial surface of the vertical jamb member and such that the second side panel of the medial member flushly contacts an interior surface of the vertical jamb member;

mounting the lateral member on the vertical jamb member such that the first side panel of the lateral member flushly contacts a lateral surface of the vertical jamb member and such that the second side panel of the lateral member flushly contacts the interior surface of the vertical jamb member; and engaging the engagement means of the second side panel of the medial member with the engagement means of the second side panel of the lateral member;

wherein the engagement means of the second side panel of the medial member comprises a plurality of substantially rectangular slots arranged in a plurality of groups, the plurality of groups spaced apart along a longitudinal axis of the medial member; each slot being arranged parallel to the longitudinal axis of the medial member and parallel to the other slots in the same group;

wherein the engagement means of the second side panel of the lateral member comprises a plurality of tabs, the tabs being spaced apart along a longitudinal axis of the lateral member, the longitudinal spacing of the tabs corresponding to the longitudinal spacing of the groups of slots on the medial member, each tab extending substantially perpendicularly from the second side panel such that the tabs are substantially perpendicular to the interior surface of the vertical jamb member when the lateral member is mounted on the vertical jamb member; and wherein each tab is received by a corresponding slot when the lateral member is mounted on the vertical jamb member the corresponding slots being determined based on a width of the interior surface of the vertical jamb member.

21. The method of claim 20, wherein a length of the medial member is determined to enable the medial member to fit either (i) between a middle hinge and a bottom hinge or (ii) between the middle hinge and a top hinge of the door assembly when mounted on the vertical jamb member; and wherein a length of the lateral member is determined to enable either (i) a top end of the lateral member to extend above the middle hinge and a bottom end of the lateral member to extend below the bottom hinge or (ii) the top end of the lateral member to extend above the top hinge and the bottom end of the lateral member to extend below the middle hinge.

22. The method of claim 20, wherein a width of the first side panel of the lateral member is substantially greater than a width of the first side panel of the medial member, such that, when the engagement means of the second side panel of the medial member engages the engagement means of the second side panel of the lateral member and when the engaged medial and lateral members are mounted on the vertical jamb member, the engaged medial and lateral members have a J-shaped cross section.

23. The method of claim 20, wherein the first side panel of the medial member defines at least one opening for receiving a fastener to affix the member to the vertical jamb member.

24. The method of claim 20, wherein the second side panel of the lateral member comprises at least one substantially rectangular cutout therein sized to correspond to a size of a door hinge barrel.

25. A method for reinforcing a door assembly, the door assembly comprising at least a door, a free-swinging side vertical jamb member, and a hinge-side vertical jamb member, the system comprising:

(I) providing a free-swinging side jamb shield, the free-swinging jamb side shield comprising:

a free-swinging side medial member comprising an elongated, single piece, metal sleeve, the sleeve comprising first and second side panels, the first and second side panels being substantially perpendicular to each other, the first side panel comprising a plurality of substantially rectangular cutouts therein for receiving a door dead bolt or door bolt plunger, the second side panel comprising engagement means; and a free-swinging side lateral member comprising an elongated, single piece, metal sleeve, the sleeve comprising first and second side panels, the first and second side panels being substantially perpendicular to each other, the second side panel comprising engagement means;

(II) mounting the free-swinging side medial member on the free-swinging side vertical jamb member such that the first side panel of the free-swinging side medial member flushly contacts a medial surface of the free-swinging side vertical jamb member and such that the second side panel of the free-swinging side medial member flushly contacts an interior surface of the free-swinging side vertical jamb member;

(III) mounting the free-swinging side lateral member on the free-swinging side vertical jamb member such that the first side panel of the free-swinging side lateral member flushly contacts a lateral surface of the free-swinging side vertical jamb member and such that the second side panel of the free-swinging side lateral member flushly contacts the interior surface of the free-swinging side vertical jamb member; and (IV) engaging the engagement means of the second side panel of the free-swinging side medial member with the engagement means of the second side panel of the free-swinging side lateral member;

(V) providing a hinge side jamb shield, the hinge jamb side shield comprising:

a hinge side medial member comprising an elongated, single piece, metal sleeve, the sleeve comprising first and second side panels, the first and second side panels being substantially perpendicular to each other, the second side panel comprising engagement means; and a hinge side lateral member comprising an elongated, single piece, metal sleeve, the sleeve comprising first and second side panels, the first and second side panels being substantially perpendicular to each other, the second side panel comprising engagement means;

(VI) mounting the hinge side medial member on the hinge side vertical jamb member such that the first side panel of the hinge side medial member flushly contacts a medial surface of the hinge side vertical jamb member and such that the second side panel of the hinge side medial member flushly contacts an interior surface of the hinge side vertical jamb member;

(VII) mounting the hinge side lateral member on the hinge side vertical jamb member such that the first side panel of the hinge side lateral member flushly contacts a lateral surface of the hinge side vertical jamb member and such that the second side panel of the hinge side lateral member flushly contacts the interior surface of the hinge side vertical jamb member; and (VIII) engaging the engagement means of the second side panel of the hinge side medial member with the engagement means of the second side panel of the hinge side lateral member;

wherein the engagement means of the second side panel of the free-swinging side medial member comprises a plurality of substantially rectangular slots arranged in a plurality of groups, the plurality of groups spaced apart along a longitudinal axis of the free-swinging side medial member; each slot being arranged parallel to the longitudinal axis of the free-swinging side medial member and parallel to the other slots in the same group;

wherein the engagement means of the second side panel of the free-swinging side lateral member comprises a plurality of tabs, the tabs being spaced apart along a longitudinal axis of the free-swinging side lateral member, the longitudinal spacing of the tabs corresponding to the longitudinal spacing of the groups of slots on the free-swinging side medial member, each tab extending substantially perpendicularly from the second side panel such that the tabs are substantially perpendicular to the interior surface of the free-swinging side vertical jamb member when the lateral member is mounted on the free-swinging side vertical jamb member;

wherein each tab is received by a corresponding slot when the free-swinging side lateral member is mounted on the free-swinging side vertical jamb member, the corresponding slots being determined based on a width of the interior surface of the free-swinging side vertical jamb member;

wherein the engagement means of the second side panel of the hinge side medial member comprises a plurality of substantially rectangular slots arranged in a plurality of groups, the plurality of groups spaced apart along a longitudinal axis of the hinge side medial member; each slot being arranged parallel to the longitudinal axis of the hinge side medial member and parallel to the other slots in the same group;

wherein the engagement means of the second side panel of the hinge side lateral member comprises a plurality of tabs, the tabs being spaced apart along a longitudinal axis of the hinge side lateral member, the longitudinal spacing of the tabs corresponding to the longitudinal spacing of the groups of slots on the hinge side medial member, each tab extending substantially perpendicularly from the second side panel such that the tabs are substantially perpendicular to the interior surface of the hinge side vertical jamb member when the hinge side lateral member is mounted on the hinge side vertical jamb member; and wherein each tab is received by a corresponding slot when the hinge side lateral member is mounted on the hinge side vertical jamb member the corresponding slots being determined based on a width of the interior surface of the hinge side vertical jamb member.

26. The method of claim 25, wherein a length of the free-swinging side medial member and a length of the free-swinging side lateral member are substantially the same.

27. The method of claim 25, wherein a width of the first side panel of the free-swinging side lateral member is substantially greater than a width of the first side panel of the free-swinging side medial member, such that, when the engagement means of the second side panel of the free-swinging side medial member engages the engagement means of the second side panel of the free-swinging side lateral member and when the engaged free-swinging side medial and lateral members are mounted on the free-swinging side vertical jamb member, the engaged free-swinging side medial and lateral members have a J-shaped cross section.

28. The method of claim 25, wherein a length of the hinge side medial member is determined to enable the hinge side medial member to fit either (i) between a middle hinge and a bottom hinge or (ii) between the middle hinge and a top hinge of the door assembly when mounted on the hinge side vertical jamb member; and wherein a length of the hinge side lateral member is determined to enable either (i) a top end of the hinge side lateral member to extend above the middle hinge and a bottom end of the hinge side lateral member to extend below the bottom hinge or (ii) the top end of the hinge side lateral member to extend above the top hinge and the bottom end of the hinge side lateral member to extend below the middle hinge.

29. The method of claim 25, wherein a width of the first side panel of the hinge side lateral member is substantially greater than a width of the first side panel of the hinge side medial member, such that, when the engagement means of the second side panel of the hinge side medial member engages the engagement means of the second side panel of the hinge side lateral member and when the engaged hinge side medial and lateral members are mounted on the hinge side vertical jamb member, the engaged hinge side medial and lateral members have a J-shaped cross section.

30. The method of claim 25, wherein the second side panel of the hinge side lateral member comprises at least one substantially rectangular cutout therein sized to correspond to a size of a door hinge barrel.

* * * * *